US006688702B1

(12) United States Patent
Abramov et al.

(10) Patent No.: US 6,688,702 B1
(45) Date of Patent: Feb. 10, 2004

(54) BOREHOLE MINING METHOD

(76) Inventors: Grigori A. Abramov, 4871 S. Dudley St., Littleton, CO (US) 80123; Marcus A. Wiley, 1602 E. Red Fox Pl., Highlands Ranch, CO (US) 80126

( * ) Notice: Subject to any disclaimer, the term of this patent is extended or adjusted under 35 U.S.C. 154(b) by 0 days.

(21) Appl. No.: 10/318,680

(22) Filed: Dec. 16, 2002

(51) Int. Cl.[7] ..... E21C 37/00; E21C 41/00; E21C 45/00

(52) U.S. Cl. ..... 299/17; 405/55; 405/58; 299/16; 175/67; 175/62

(58) Field of Search ..... 299/17, 16; 175/67, 175/61, 62, 424; 405/55, 58

(56) References Cited

U.S. PATENT DOCUMENTS

| | | | | | |
|---|---|---|---|---|---|
| 3,961,824 | A | * | 6/1976 | Van Eek et al. | 299/17 |
| 4,226,475 | A | * | 10/1980 | Frosch et al. | 299/13 |
| 4,245,899 | A | * | 1/1981 | Lundberg | 353/117 |
| 4,458,766 | A | * | 7/1984 | Siegel | 175/25 |
| 4,473,706 | A | * | 9/1984 | Lee et al. | 562/506 |
| 4,536,035 | A | * | 8/1985 | Huffman et al. | 299/17 |
| 4,906,048 | A | * | 3/1990 | Babichev et al. | 299/17 |
| 4,915,452 | A | * | 4/1990 | Dibble | 299/17 |
| 5,031,963 | A | * | 7/1991 | Babichev et al. | 299/17 |
| 5,127,710 | A | * | 7/1992 | Babichev et al. | 299/17 |
| 5,197,783 | A | * | 3/1993 | Theimer et al. | 299/17 |
| 5,246,273 | A | * | 9/1993 | Rosar | 299/4 |
| 5,366,030 | A | * | 11/1994 | Pool et al. | 175/215 |
| 5,380,127 | A | * | 1/1995 | Caleix et al. | 405/130 |
| 5,413,184 | A | * | 5/1995 | Landers | 175/62 |
| 5,690,390 | A | * | 11/1997 | Bithell | 299/4 |
| 5,785,133 | A | * | 7/1998 | Murray et al. | 175/62 |
| 5,879,057 | A | * | 3/1999 | Schwoebel et al. | 299/17 |
| 6,460,936 | B1 | * | 10/2002 | Abramov et al. | 299/17 |

FOREIGN PATENT DOCUMENTS

| | | | | |
|---|---|---|---|---|
| SU | 1770570 | A1 | * 10/1992 | E21C/45/00 |

* cited by examiner

*Primary Examiner*—David Bagnell
*Assistant Examiner*—Katherine Mitchell

(57) ABSTRACT

A Borehole Mining method comprising driving a borehole, into a production zone under a low-degree angle α (0<α<35°), installation in said borehole a mining device with a hydromonitor and eductor, water-jet cutting of rock, pumping-out a slurry, and creating a cavity. Said tool is positioned such that the hydromonitor is oriented at an angle β to the horizontal plane. The projection on said plane of the water-jet equals to the desired span of the driven cavity. The borehole may be driven sinking or raising. The BHM tool is inserted/removed from the borehole while mining without rotation, extending said cavity along the borehole. Said borehole can be driven from a land or water surface trough the mother-well drilled vertically and then deviated. It also may be driven straight from an underground mine or open pit floor. After a creation of said cavity, it may back-filled with a waste or hardening material.

22 Claims, 19 Drawing Sheets

BOREHOLE MINING METHOD

BACKGROUND OF THE INVENTION (a) Field of the Invention

This invention generally relates to systems for carrying out remote hydraulic extraction (mining) of rocks, minerals and industrial materials, and more specifically, but not by way of limitation, to hydraulic borehole mining (BHM) systems, applied through non-vertical (near-horizontal) boreholes which allow simplification of the technology and reduction of drilling procedures by increasing the volume of material to be mined per borehole.

This BHM method is intended for extraction of mineral resources and industrial materials and creation of underground caverns through inclined boreholes, including deviated boreholes. This technology can be applied from the earth surface, as well as from underground mines, open pit floors, valleys and from water surfaces. The technology can be used in geological exploration for bulk sampling; in building of underground storage; in stimulation of in-situ leaching, oil, gas and water production; in construction of custom foundation, underground collectors, walls, and barriers; etc. The technology can be used to solve environmental problems, underground firefighting and fire prevention and other applications requiring remote operating and control of the mining processes.

(b) Discussion of Known Art

Borehole mining as a remote underground mining method is based on water jet cutting of rock material. It is accomplished by pumping high-pressure water down to the working area from the surface (pit floor, underground mine or floating platform) by a BHM tool, lowered into a pre-drilled borehole. At its bottom, the tool has a hydromonitor with a nozzle, which creates a water jet to cut rock and create slurry. The created slurry is simultaneously pumped back to the surface by the eductor, located mainly at the tool's very bottom. The slurry is then separated in a settling pit or tank, and clarified water is pumped down again to the borehole. While extracting rock material, underground caverns (stopes) can be created. The shape and proportions of these stopes are the matter of tool manipulation in a hole, which is simply a combination of rotating the tool and sliding it along the borehole axis. Being sufficiently extended along the borehole, these caverns may be used as underground storage for oil, gas and other gaseous or liquefied products.

BHM boreholes are drilled mostly vertically. There are several factors requiring this orientation. First, the BHM tool is rotated in a borehole while mining. During this rotation, the water jet is "flying" just over the slurry level, which naturally is strictly horizontal. Thus, if the tool has even a slight deviation from the vertical axis, the water jet may hit the water (slurry), which will break the jet and decrease its rock cutting ability.

Another problem is transportation of the slurry from the rock face to the tool's eductor zone or borehole sump. If the tool is deviated from the vertical axis, then one side of the cavern created will be above the other. The transporting slope from one side will therefore be steeper than from the other, creating uneven conditions for slurry transportation and making a created cavern asymmetrical. It finally may affect the stability of the cavern and cause an unwanted collapse.

The vertical (chimney-like) ore body shape would be the most appropriate for conventional vertical borehole mining.

This requires drilling a borehole along a vertical axis followed by extraction of the ore. Meanwhile, most of the known sedimentary deposits and ore bodies have horizontal or near-horizontal shape and orientation. Except Kimberlite "pipes" and a few known unique-shape deposits, all other ore bodies could be qualified as horizontal or being developed by horizontal layers. In order to develop them by vertical BHM, numerous equally spaced boreholes have to be drilled. The distance (D) between boreholes usually equals the BHM tool reach diameter (usually up to a max. of 9–11 m) plus some offset, if required for between-stope pillars (2–4 m), so then D=10+3=13 m.

It is easy to calculate, for example that the number of boreholes required for the development of an ore body whose plane square area equals to 10,000 $m^2$ will be:

10,000/(13×13)=59 boreholes, which is a significant number for a 100 m×100 m area. This means that for the development of those types of ore bodies, using conventional BHM, a massive drilling stage will increase the project budget. Additionally, since every drill hole requires surface area, most if not all of the surface over the deposit will be disturbed.

Also, most geo-technological and environmental tasks require near-horizontal development and/or construction (ground walls, drainage collectors and so on), requiring massive drilling along those features. It could be more easily created through a single deviated borehole or one drilled from underground works.

Conventional (vertical) borehole mining suffers from another disadvantage. The vertical BHM is accomplished by moving the tool up (bottom-up schematic) or down (top-down schematic) the borehole. Both of these schematics have problems. While moving the tool "bottom-up", the eductor is moving together with the tool away from the stope bottom (sump) area, where slurry will collect. In this configuration the material cut from the rock face is free-falling and accumulating on the bottom instead of being removed from the stope.

While moving the tool "top-down" the tool becomes suspended in the stope. Any collapse or fall-off from the stope wall may easily damage the tool, even to a point where it may become impossible to remove the tool from the hole.

Additionally, while increasing the diameter of a cavity, the roof or portion(s) of it may collapse while mining. These collapsed rock masses may interfere with the water jet and be an obstacle on its trajectory between the nozzle and the cutting rock face. In other words, these collapses may prevent BHM process from achieving the maximum possible diameter of the cavern and thus decrease the entire BHM effectiveness. To overcome these disadvantages, a mining technology using inclined, deviated, or near-horizontal boreholes is required, and is the topic of this invention.

The U.S. Pat. No. 4,536,035 to Huffinan et al covers a double-drill hydraulic mining method which includes drilling a slant borehole along the production vein footwall and a vertical borehole to intersect the bottom of the first one. Then, the mining tool is inserted into the slant borehole, while a pumping unit is inserted into the vertical borehole. The mining tool includes a water jet nozzle which cuts the rock while the tool is slowly rotated back-and-forth through 180° and pulled slowly out from the borehole. The created slurry rolls down to the bottom part of the vertical borehole to the pumping unit and is delivered to the surface. This method allows the creation of extended caverns along the slant borehole.

The Huffman method of mining suffers from the following disadvantages:

First, a large diameter (24") borehole has to be drilled to remove the mined material. This increases drilling procedures and overall mining cost.

Second, the drilling of two boreholes requires a certain footprint on the earth's surface to be developed for drill rig sites, sediment ponds and the other equipment. This is not always possible due to the natural landscape, agricultural and environmental requirements and/or other land surface usage (city or industrial zone, private lands and so on).

Third, the Huffman method has a limited application area. It can be applied "at an angle-pitched mineral vein extending downwardly", as it is stated in their claim 1. In other words, application in an irregular-shaped ore body will not be as effective as in that of a sloping vein. Additionally, this method is developed to mine seams "having dip angle ranging from 25° to 75°" as it explained in their Detailed Description. Thus, this method cannot be applied in seams lying in a "flat" range between 0° and 25°.

Fourth, this method requires a reverse rotation of the tool within 180° to create a domed cavern, extended along the slant borehole. This reverse rotation tool operation requires special joints between the tool's sections to prevent their unscrewing. These joints are available industry-wide, but their usage makes the tool's construction more complicated, heavier, and larger diameter. This in turn requires drilling of a larger diameter borehole, raising the overall cost of mining.

The U.S. Pat. No. 4,226,475 to Frosch, et al covers another remote underground mineral extraction method. This method requires drilling of a vertical borehole toward a production zone and then deviation of that borehole along the production zone. Then, similar to the Huffman method, a vertical borehole is drilled to intersect the end zone of the first borehole to pump up the pregnant slurry developed by the mining tool while removing it from the deviated borehole. Unlike the Huffinan method, this method allows development of near-horizontal layers, but still suffers from almost the same set of disadvantages.

Additionally, this method is extremely expensive due to the usage of custom designed self-walking support vehicles. It is also an extremely complicated technology, as it requires numerous precise remote operations (cutting of drainage tunnels, tool positioning and so on).

Also, Frosch suggests steering of the mining head attached to the flexible high pressure hose by steering nozzles in a manner similar to operating a spacecraft in weightlessness. According to the invention, turning on a side nozzle will steer the inserting tool to the opposite direction. The force of gravity, which will try to turn the heavy working head down, is much greater than the reactive force from the steering nozzle. More likely, the head will constantly have a tendency to dip downward, thus making it difficult to steer.

Finally, in practice, while inserting the mining head into the borehole, the drill pipe string is usually twisted. Due to this twisting, the orientation of the mining head can be easily lost. Without knowing the current position of the head, its further orientation becomes nonsensical.

The U.S. Pat. No. 4,245,699 "Method for In-situ Recovery Of methane From Deeply Buried Coal Seams" to Johannes W. M. Steeman is also known. Steeman offers to drill " . . . at least one borehole from the surface into a selected (coal) seam wherein a plurality of cavities are formed. The cavities may be formed by chemical, physical or mechanical recovery of the coal".

As an example of a technique, which allows the creation of said cavities, Steeman refers to the U.S. Pat. No. 3,961,824 "Method and System for Winning Minerals" to Wouter Hugo Van Eek. This invention covers a device (scraper) allowing under-reaming a borehole and thus creating the required extended cavity.

The Steeman method works as follows: A borehole is drilled from the surface and then deviated, penetrating into a production interval under a small angle to the horizon in the downward direction. Then a mining device is inserted through the borehole in to the working zone. This mining device consists of a working head, having numerous zigzag folding, mainly hollowed cylindrical sections, armored with rock-breaking scraping elements. This working head is attached to a drill pipe string extending to the surface. To fold this scraper in the working (zigzag) position, a cable is attached to the furthest folding section of the tool. The other end of this cable reaches the surface, and thus can be operated from there. Instead of the cable, a second duct-pipe may be installed inside the tool. This pipe may not only fold but also stretch the working head back to a transporting position.

Once introduced into the hole, the mining tool is slid up and down and slowly folded, so that the cutting elements begin to widen the borehole. The high-pressure water is pumped from the surface down through the tool. At its very bottom it has at least water-jet nozzle. This nozzle serves two main purposes. First, to help the mechanical cutting elements by hydro-jet cutting of rock, and second, to remove created slurry by circulation of this liquid through the well. The inner pipe may have a direct connection to said nozzle (s) and supply high-pressure water. Thus, one of this tool's embodiments includes a dual wall structure and may have two channels, inner pipe and an annulus between these two pipes, one for working water supply, the second for slurry removal.

According to Steeman, the scraper increases the size of the borehole within the working interval to some "near-collapse conditions". The collapse "occurs suddenly" causing development of a fissure system. This system opens access to methane and thus intensifies its production.

The first disadvantage of the Steeman method is uncertainty of technological characteristics, which lowers its application reliability. According to Van Eek, the scraper under-reamer increases the size of the borehole within the working interval to "near-collapse conditions". These "near-collapse conditions" are the uncertainty. Practically, rock-mechanical characteristics of natural strata (such as hardness and stability) are not consistent even within a small area of the ore body. Thus, the cavity may collapse before its completion is accomplished and the scraper is removed from the borehole. It will damage the equipment or even cause loss of it. On the other hand, the span of a created cavity may be not enough for its collapse (too stable of an interval) even by repetitive reversing of the water pressure in the cavity, as is offered by Steeman. The method also has low reliability due to employing a mechanical mining device having numerous parts, sub-assemblies, hardware, fasteners and other units.

The second disadvantage of the Steeman method is its limited application area due to the following two reasons:

1) It requires very consistent rock physical characteristics (hardness and stability) along the cavity development direction, which is practically impossible to find in natural conditions.
2) Since the scraper is a mechanical device, the size of created cavities has a limitation which is equal to the scraper's section length in collapsed (zigzagged) position. Practically, it means that the span can reach maximum 1.5–2.0 m, which may not be enough for collapse nor for the storage purposes. Meanwhile, the size of the cavity may play a pivotal role since its collapse is further expected.

The third disadvantage is uncertainty of slot orientation. Unlike rotational under-reaming, the scraping of a borehole while folding the device widens its profile in two opposite directions or creates a slot with substantially parallel walls. For the expected further collapse, it is very important that this slot will be oriented in a horizontal position. The closer a slot is to the vertical orientation, the more stable it is and thus its collapse is less likely. As mentioned earlier, the bottom portion of a drill string may twist relatively to its upper end. The deeper the borehole, the more twisting that may occur. In deviated boreholes this twisting is even more likely. Meanwhile, the described device does not provide any information about the orientation of the working head (scraper), so the driving slot orientation is unknown. This further lowers the method's reliability and repeatability.

The fourth disadvantage is water jet effectiveness. According to the invention, the working head contains at least one nozzle. It is supposed that the water jet will improve (accelerate) the cutting process as it will cut rock along with the mechanical means. It probably will, but not very effectively due to the fact that the borehole is filled with the water/slurry and therefore the jet will be flooded. In comparison to a discharge into a "dry" environment, this will decrease jet's effective cutting radius up to 6 to 10 fold, so the jet will perform all expected functions except effective rock cutting.

The fifth disadvantage is tool complexity. From the patent drawing, the pulling cable, which is supposed to fold a zigzag scraper, is put inside the tool sections and further up the pipe string. That means that the tool assembly (including a pipe string) will be significantly complicated, since in practice it is very difficult to attach (detach) pipes to (from) each other, while having an extended cable inside. In short, the mining device assembly/disassembly is a very complicated procedure.

To overcome the problems of the patents discussed above requires the development of a technology that allows the creation of cavities through gently sloped boreholes. This technique must also effectively create cavities in/through strata with variable characteristics. A remote water jet technology, such as Borehole Mining, applied through sloped boreholes is a solution to the above-mentioned problems and requirements. These boreholes can be deviated from vertical boreholes, if drilled from the land or water surface, or straight, if drilled from underground mines, open pit floors, valleys and other similar workings.

SUMMARY

Borehole mining as a remote operated technology is well known and has been developed during recent decades. It adds to an existing mining technological arsenal and decreases environmental impact. However, BHM is not free from certain disadvantages, slowing its further adoption in modern mining, environmental and other industries. One of these disadvantages is the expense of drilling the borehole, which can be 10–25 times the cost of the actual mining. Thus, any decrease of this ratio would significantly improve the effectiveness BHM.

A near-horizontal borehole mining technology can solve the problems left unsolved by known art. This type of borehole could penetrate an irregular-shaped ore body along its longest axis and eliminate numerous vertical access-wells. If underground workings are available, there is no need for deviated boreholes. In this case, only a straight borehole is required. This BHM technique will allow quick and cost-effective access to remote pockets, horizontal seams, and other ore whose development by today's traditional technologies is not economic.

PURPOSE OF THE INVENTION

The primary purpose of this invention is the development of non-vertical or, more specifically, near-horizontal borehole mining technology. It allows for drilling boreholes along the production layer and then extracting material without drilling new boreholes "back-to-back". It also allows employment of a multi-directional drilling technology offering a spoke-like set of deviated boreholes driven through the same mother-well. This significantly decreases the cost of drilling operations and thereby decreases the overall cost of the entire process. The other important aspect of the horizontal BHM is an increase in safety, since the mining and thus collapsing zones will be moved far away from the drill rig and personnel operating site. To realize this idea, horizontal techniques and equipment should be developed, allowing effective extraction of different mineral materials in a wide variety of hydro-geological and environmental conditions.

DRAWINGS

The accompanying drawings illustrate preferred embodiments of the present invention according to the best mode presently devised for making and using the present invention.

Figure 4:
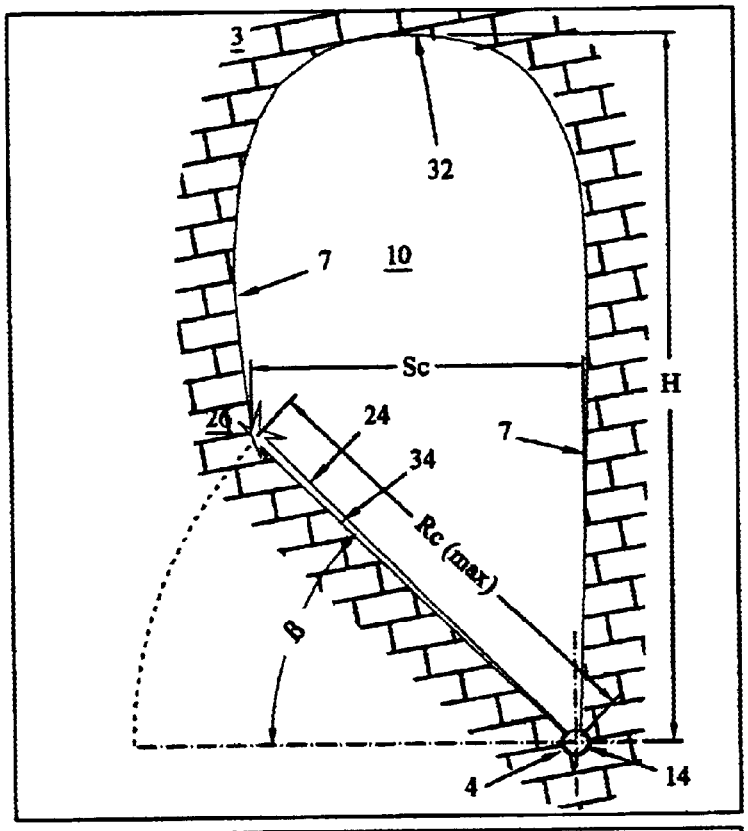
Figure 4:
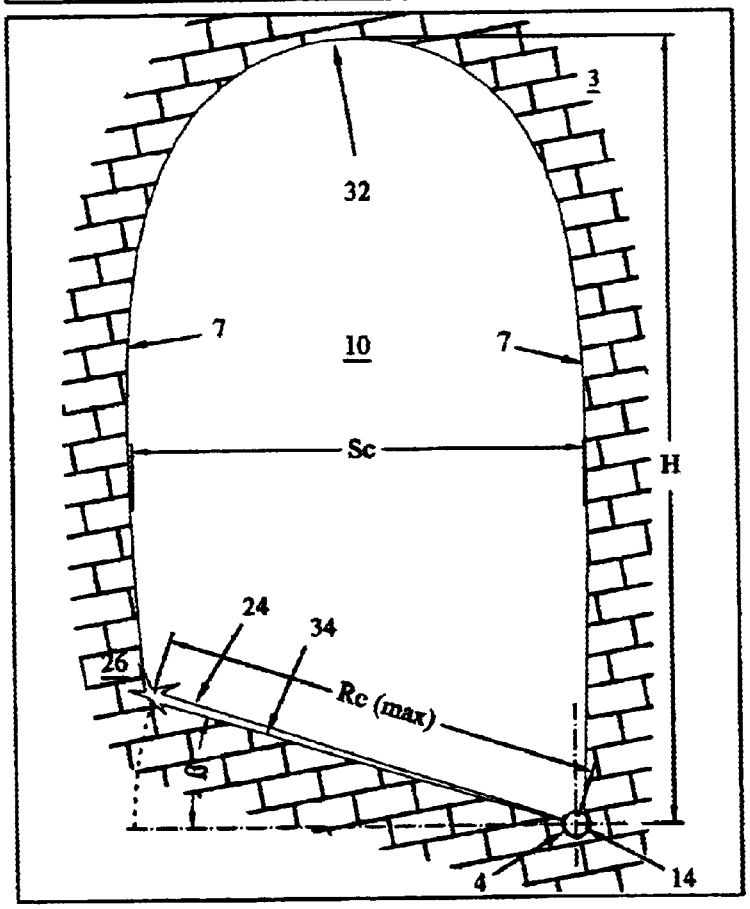
Figure 5:
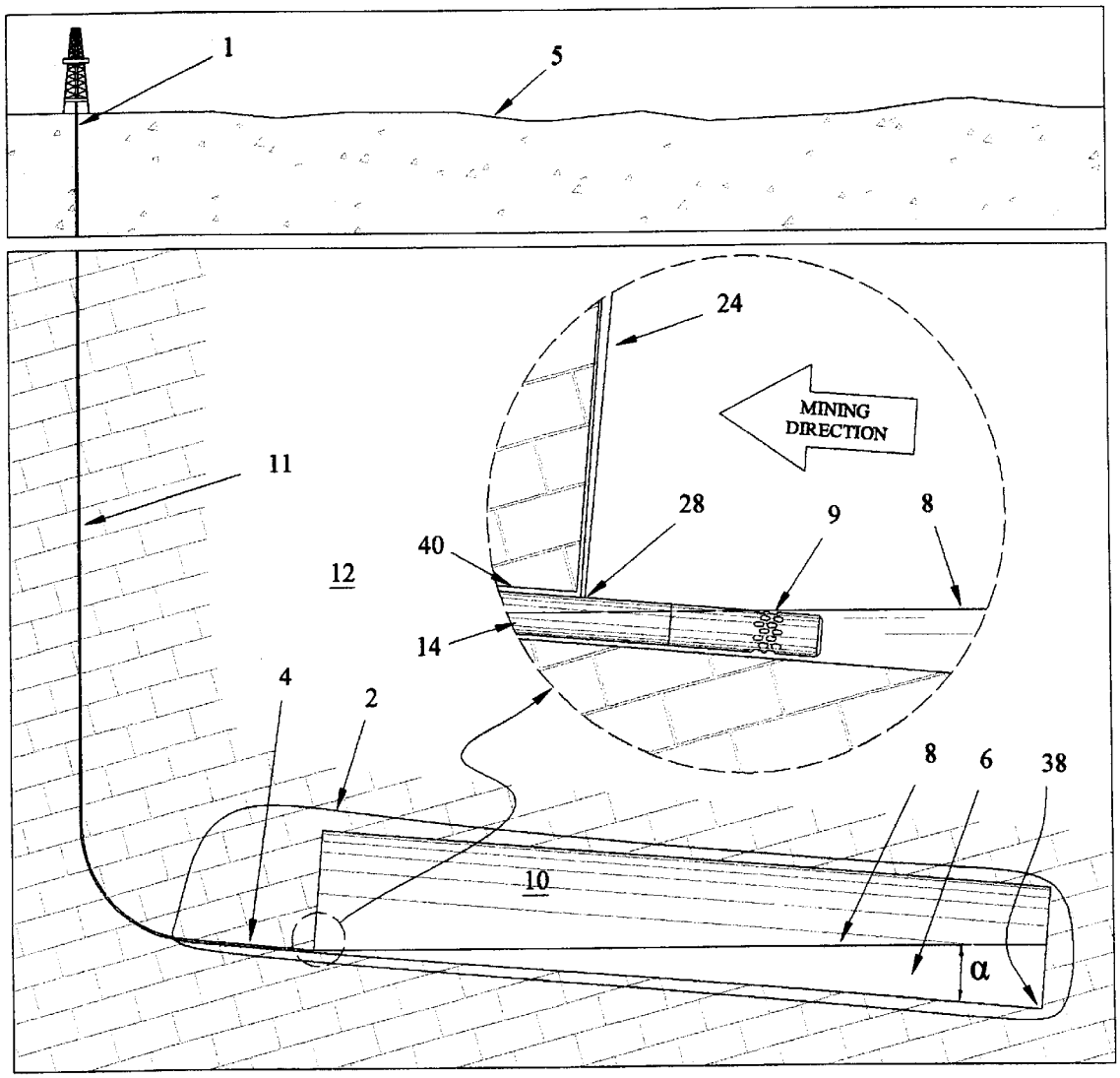
Figure 6:
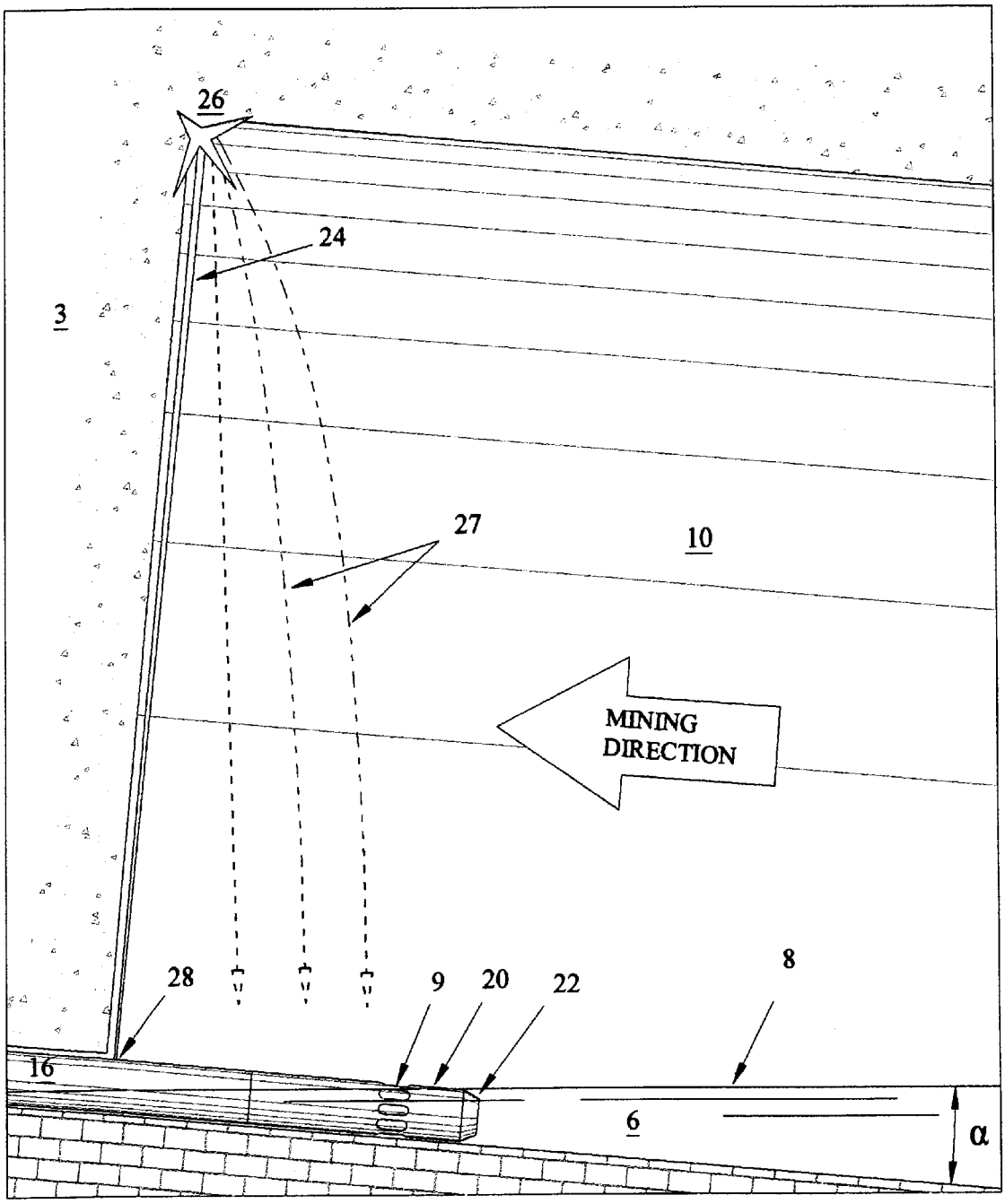
Figure 7:
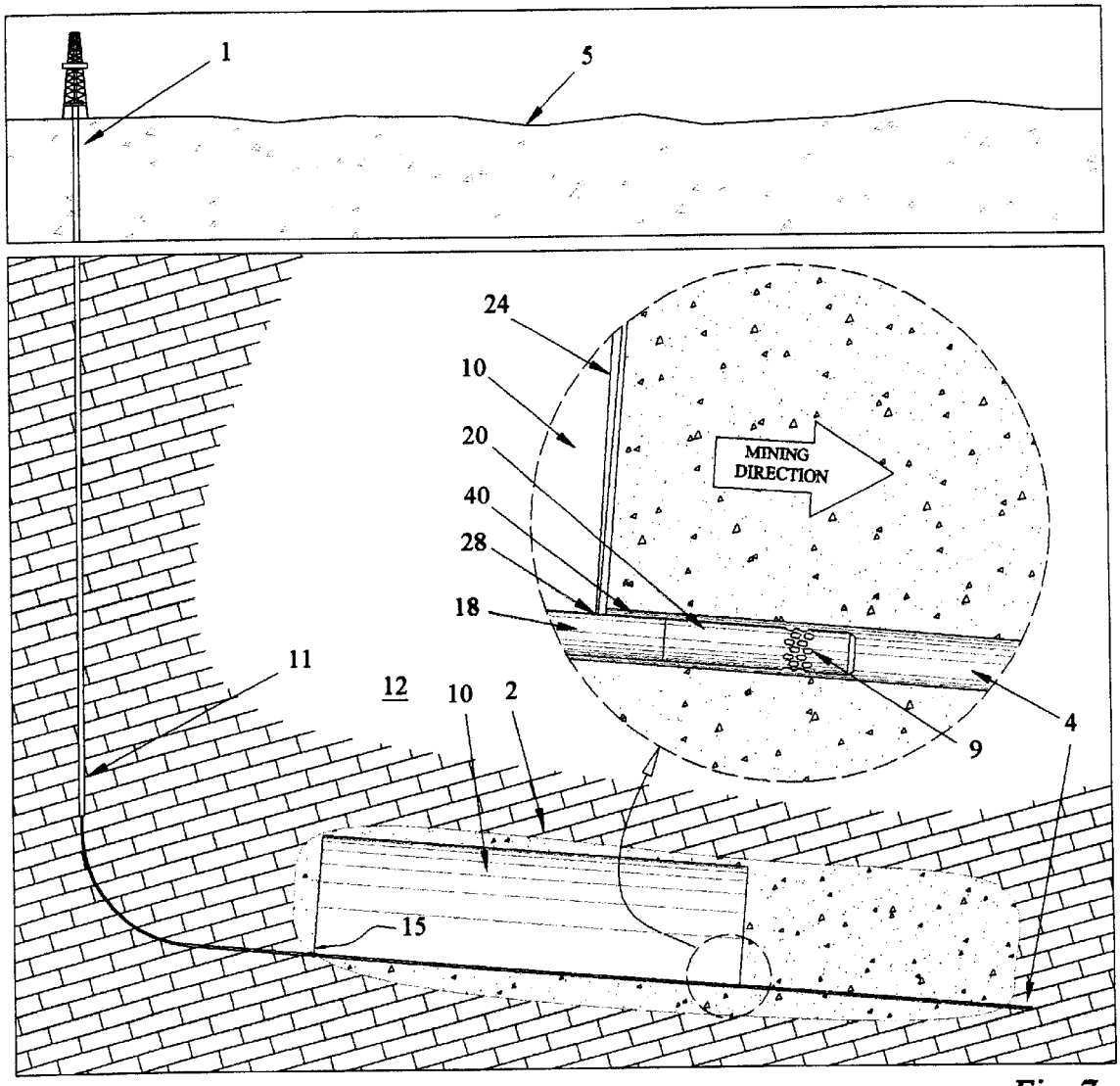
Figure 8:
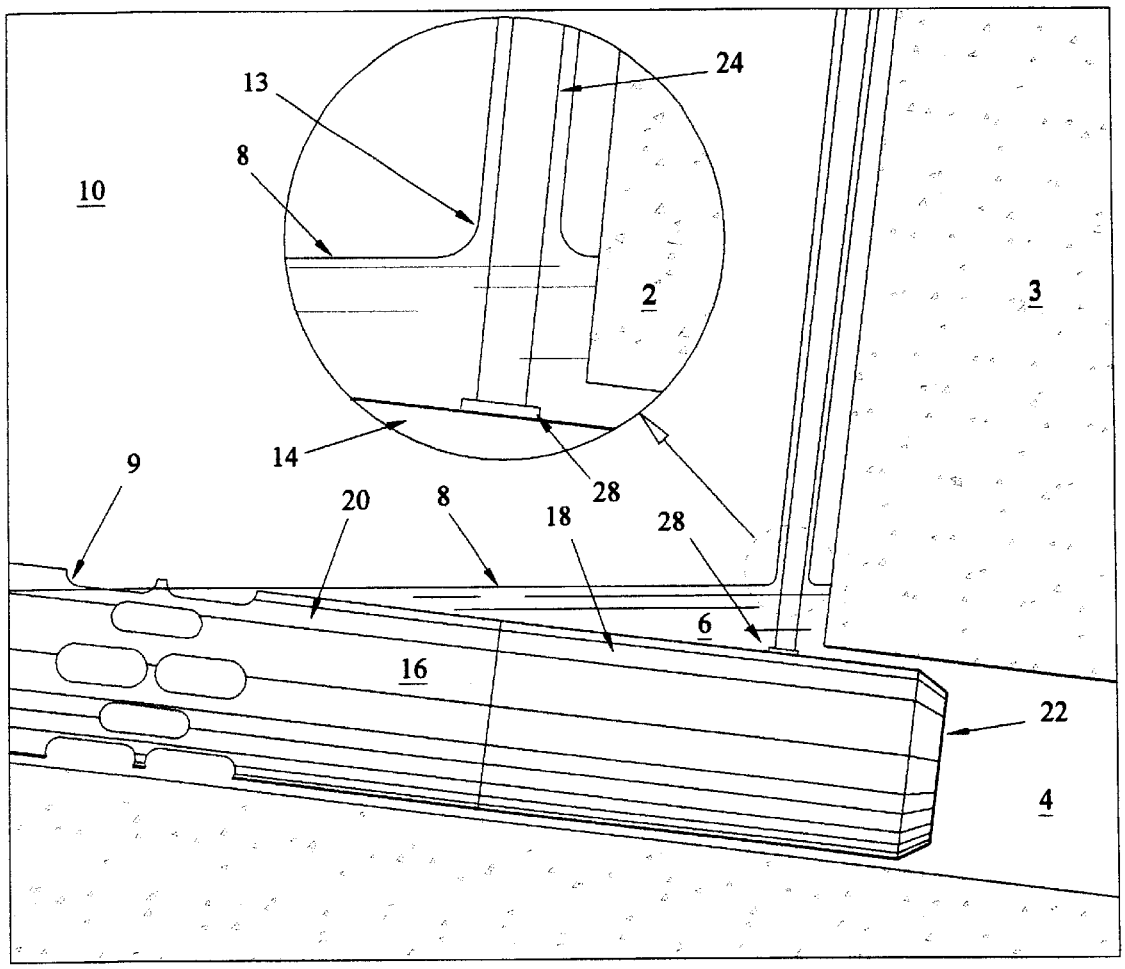
Figure 9:
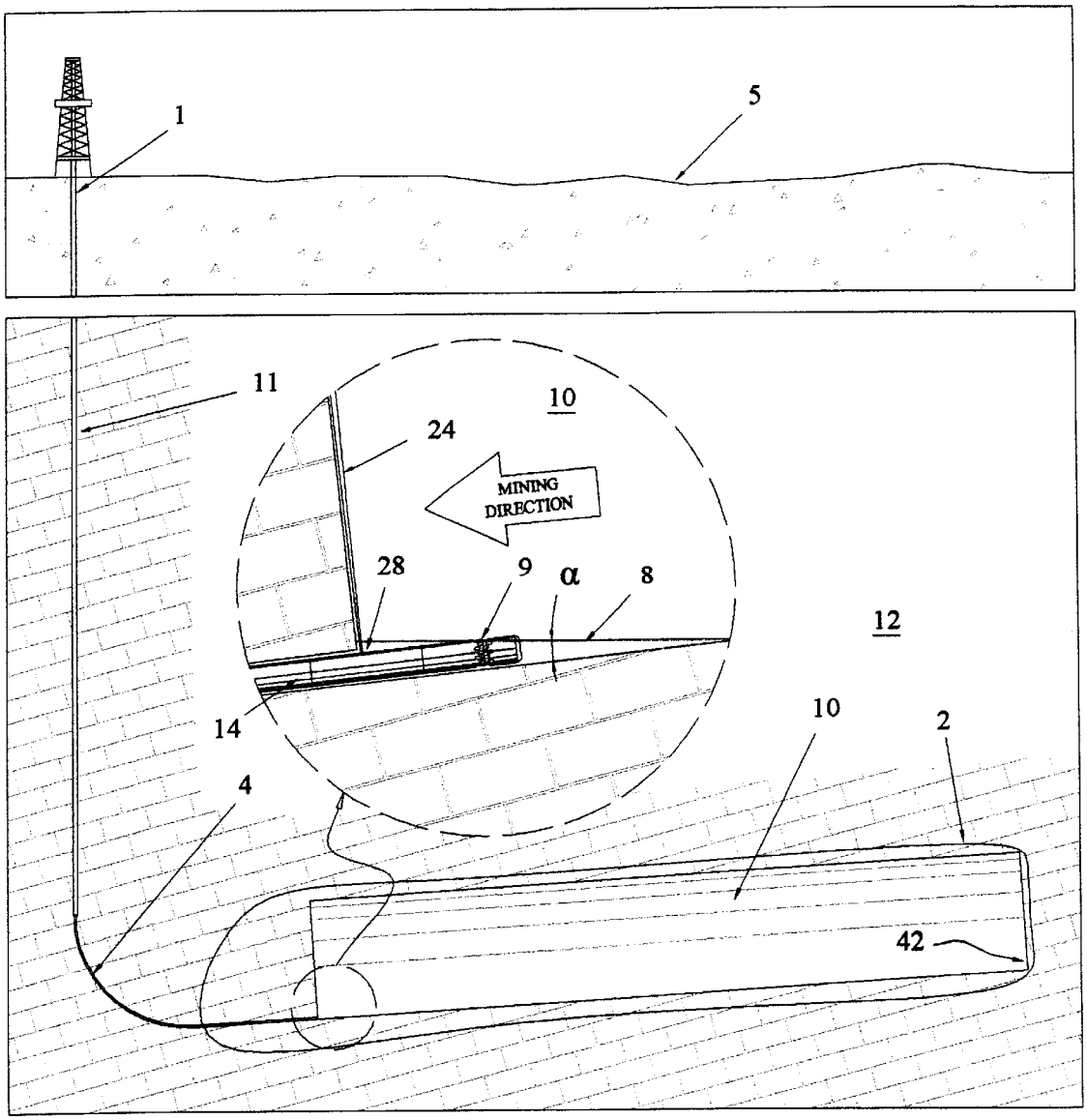
Figure 10:
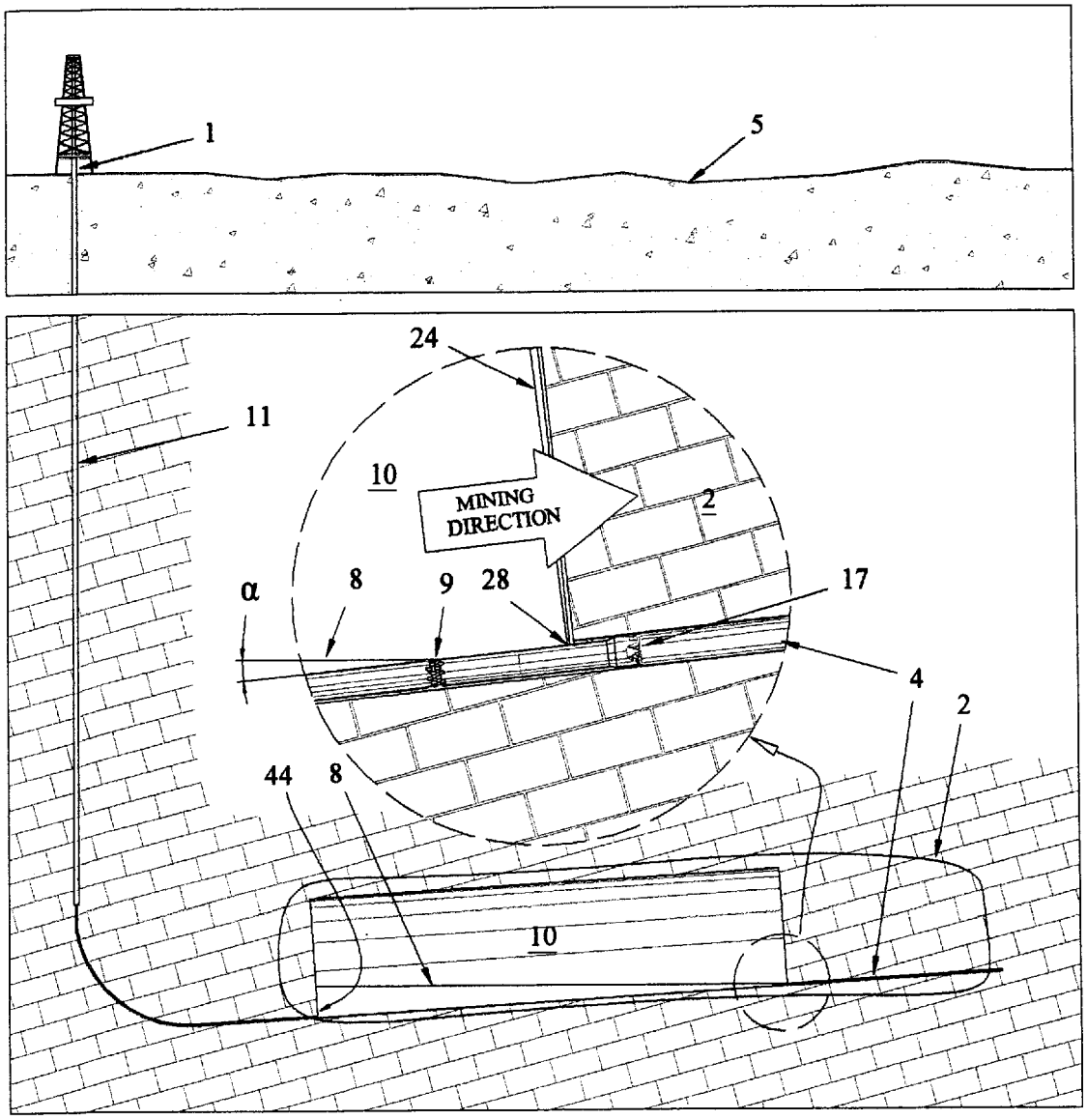
Figure 11:
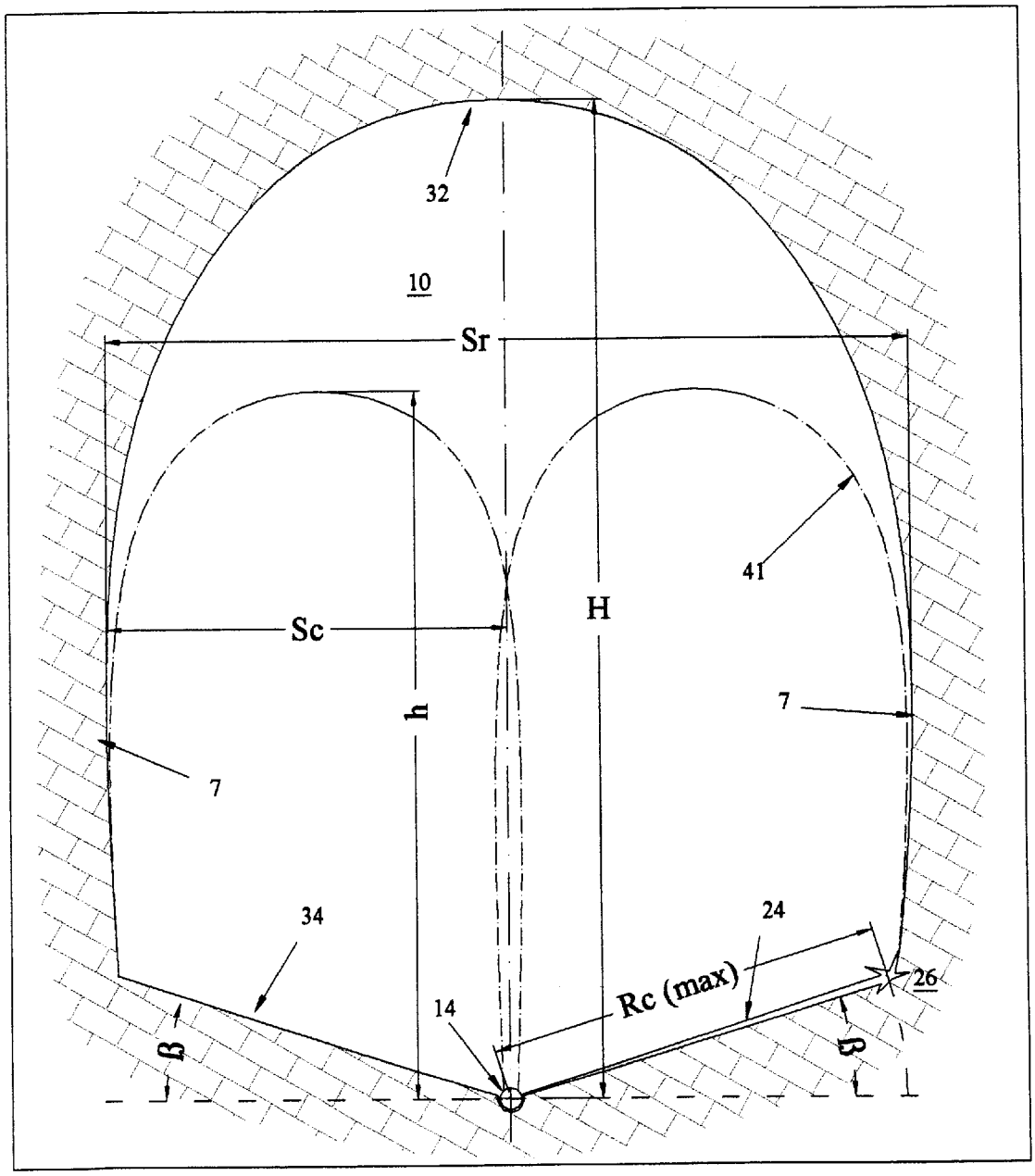
Figure 12:
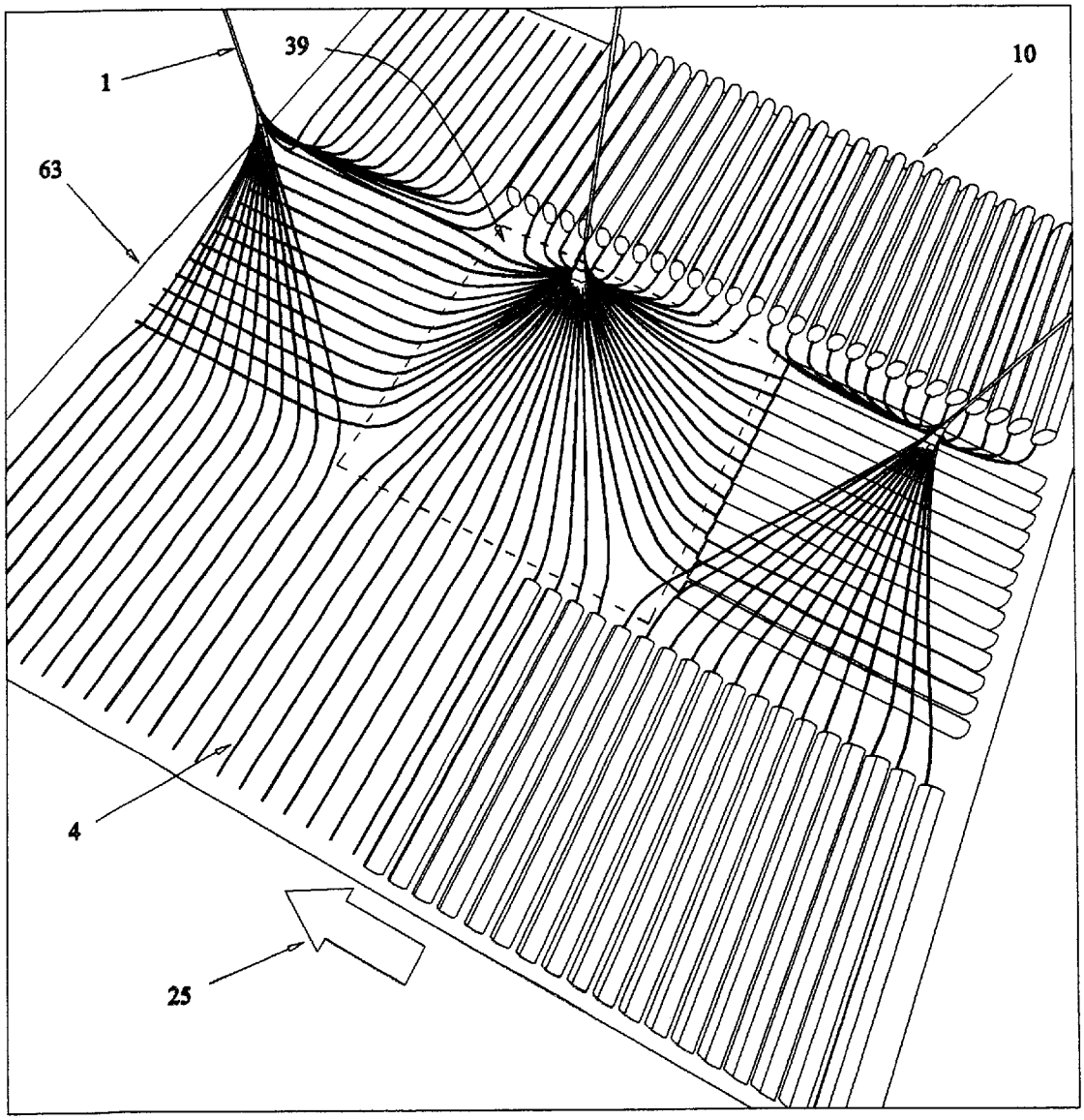
Figure 13:
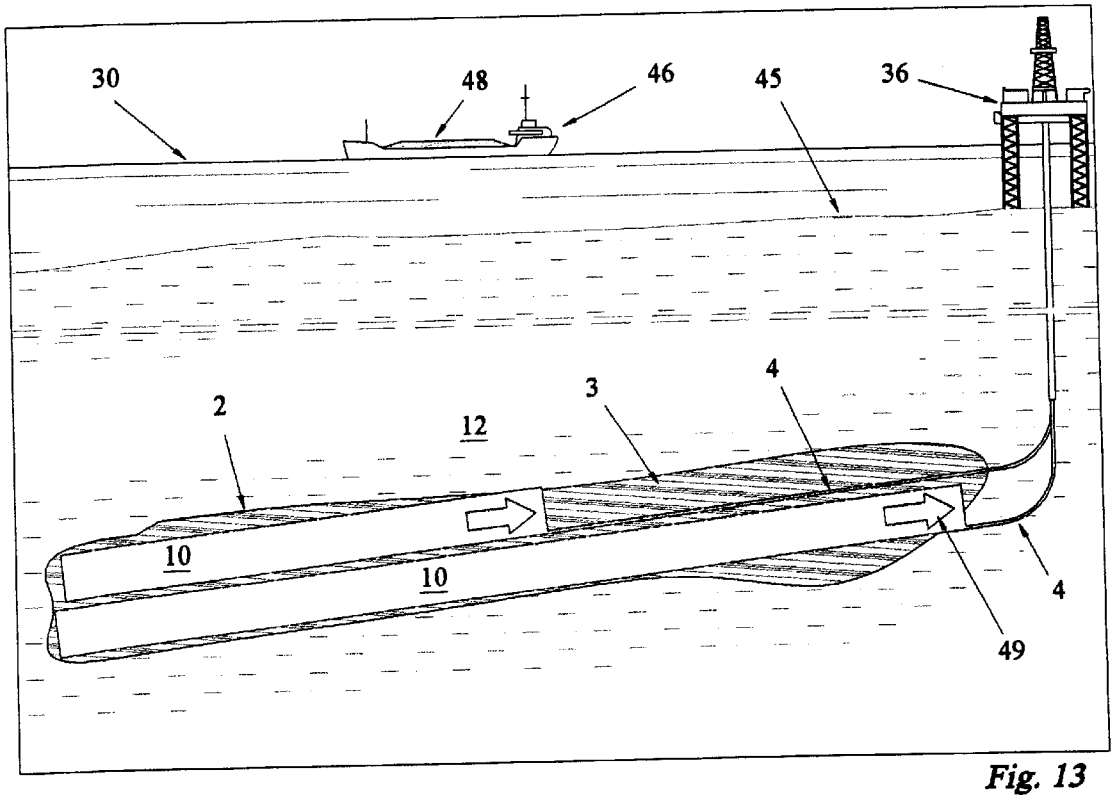
Figure 14:
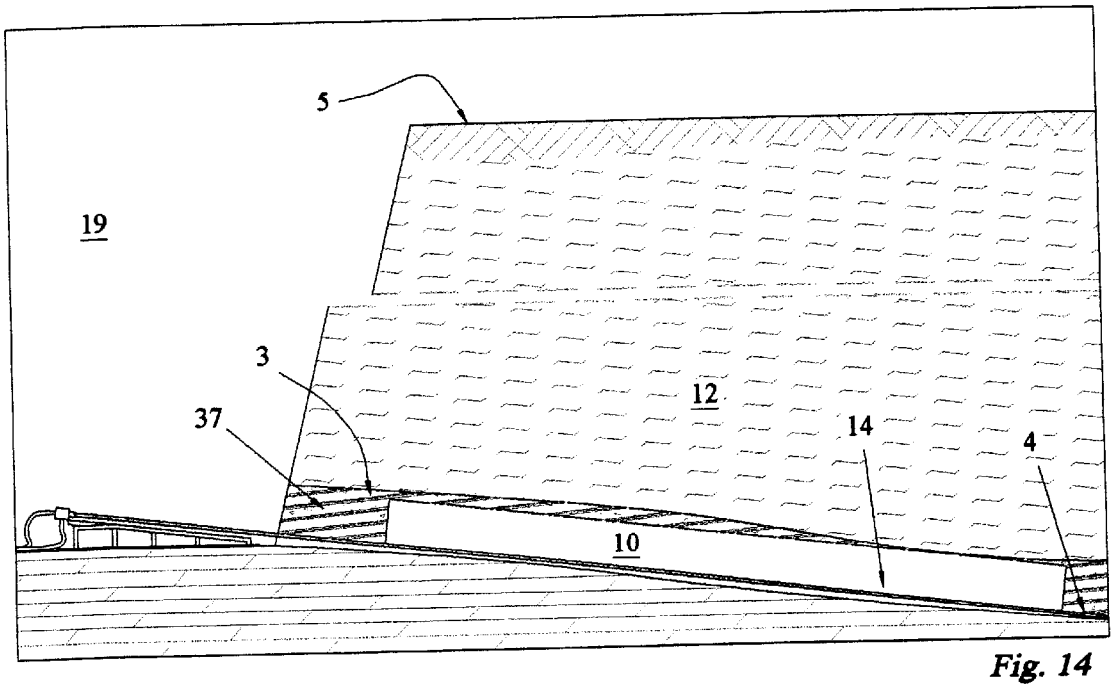
Figure 15:
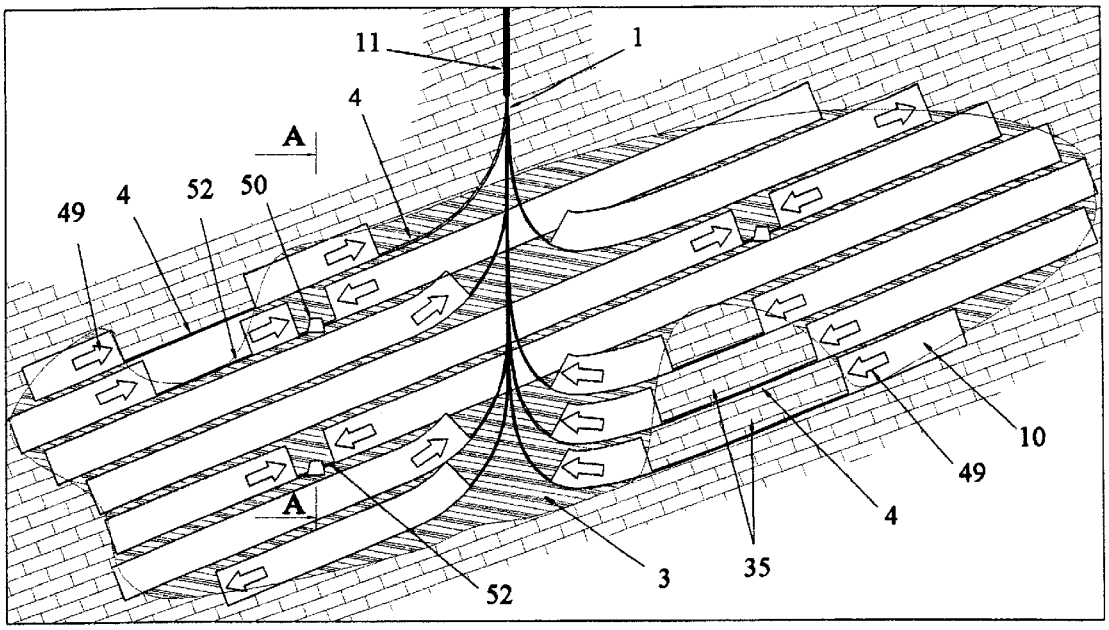
Figure 16:
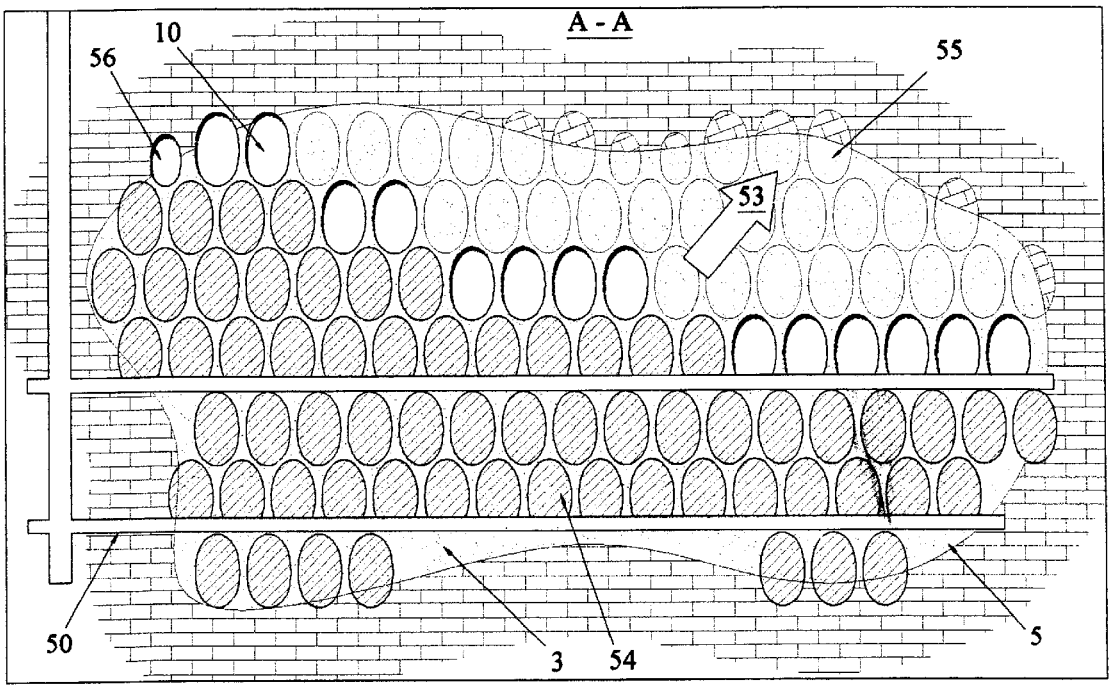
Figure 17:
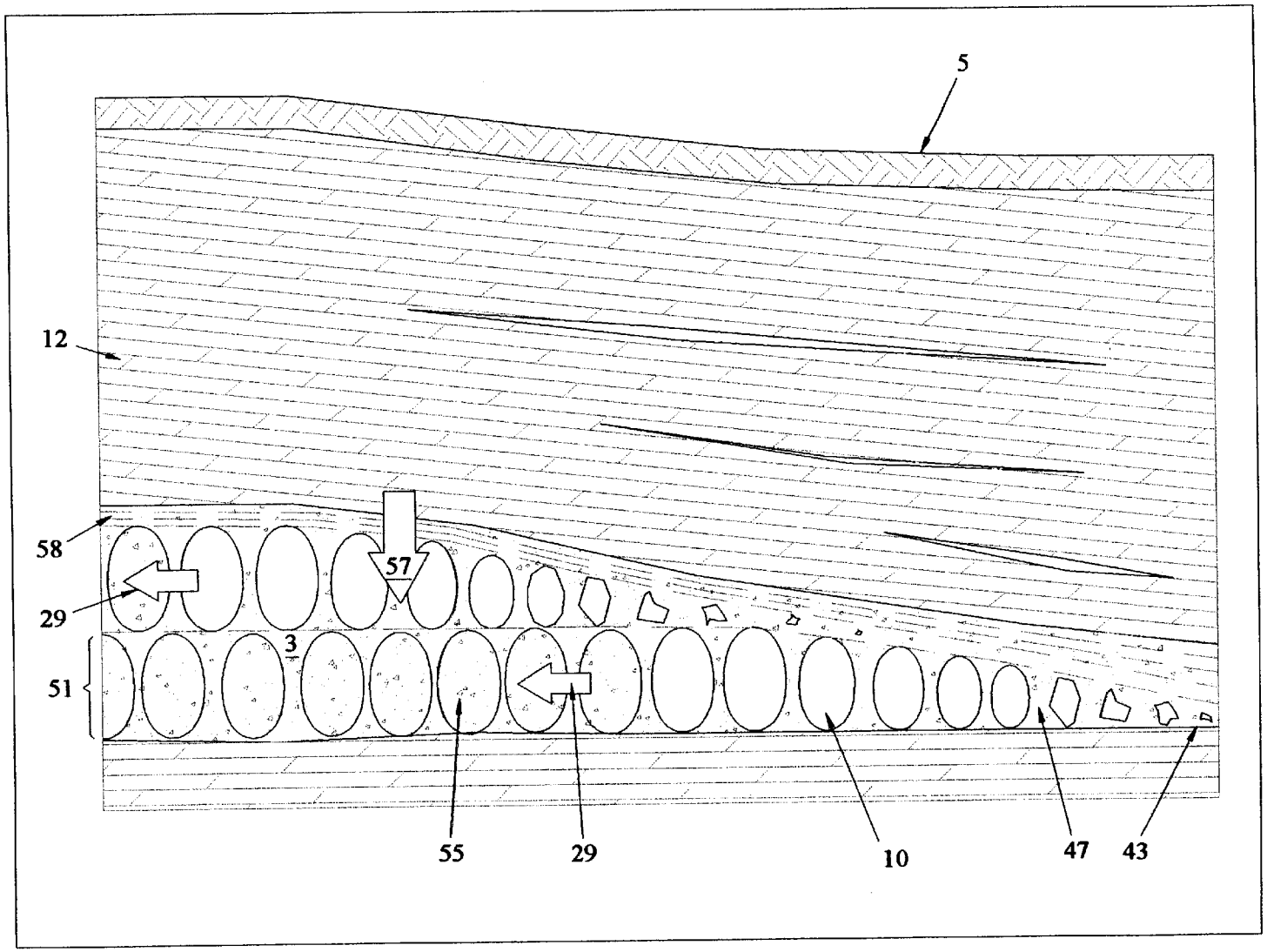
Figure 18:
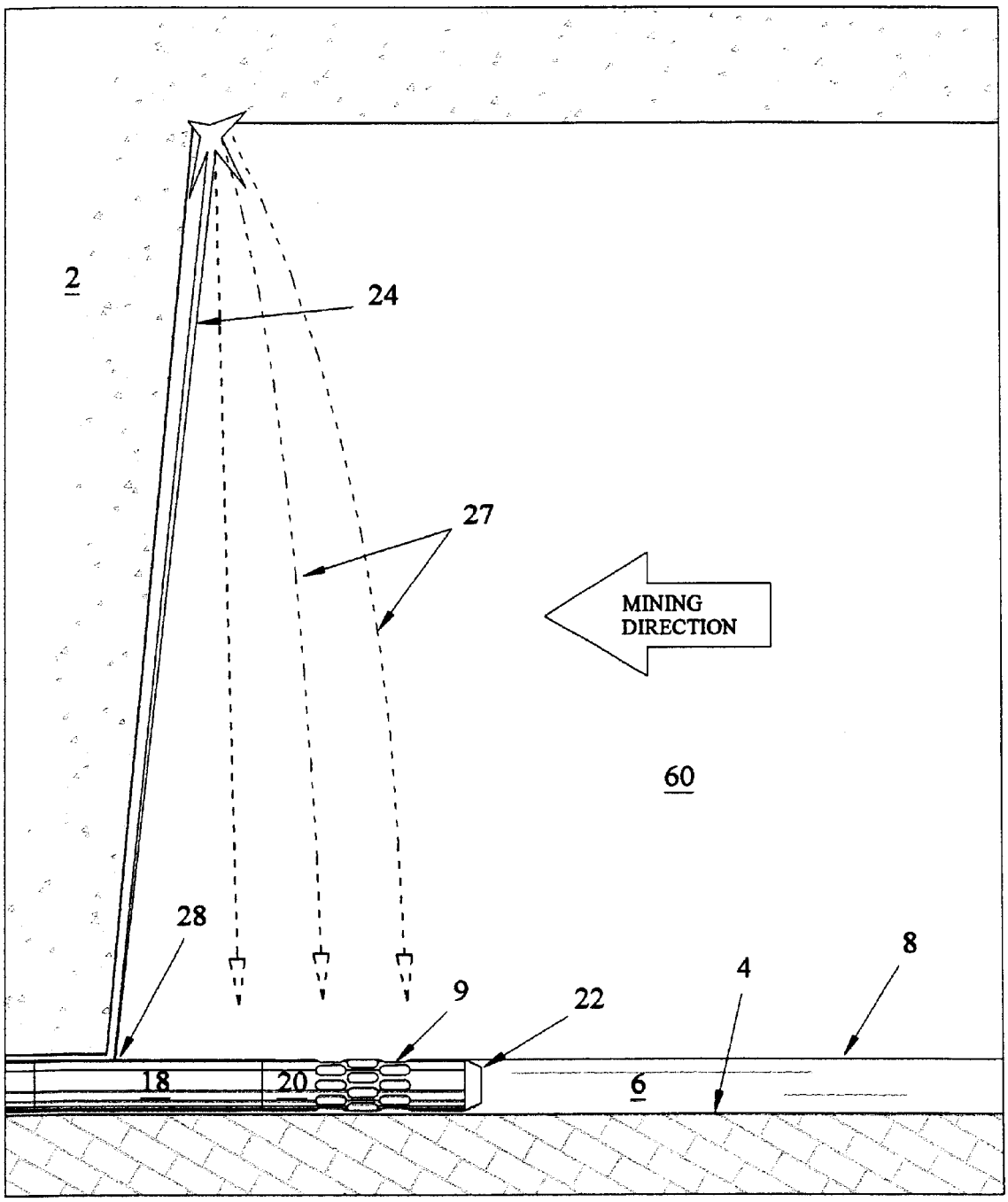
Figure 19:
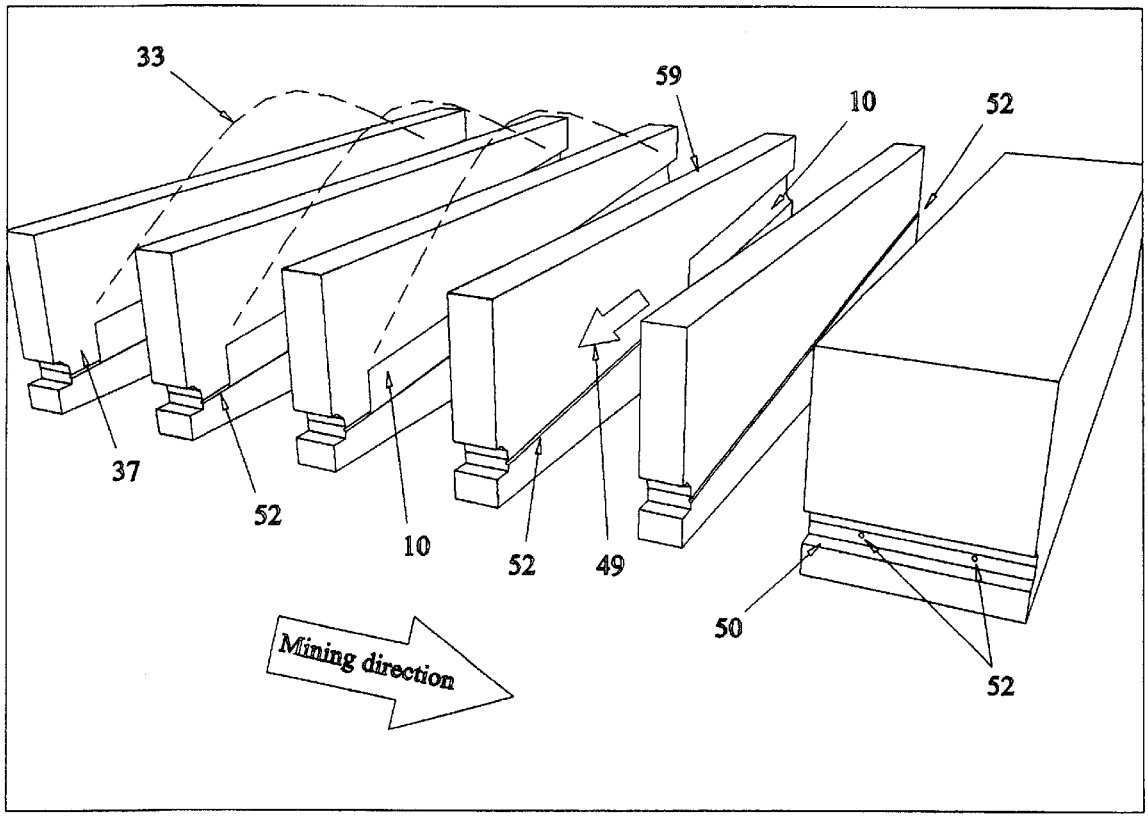
Figure 20:
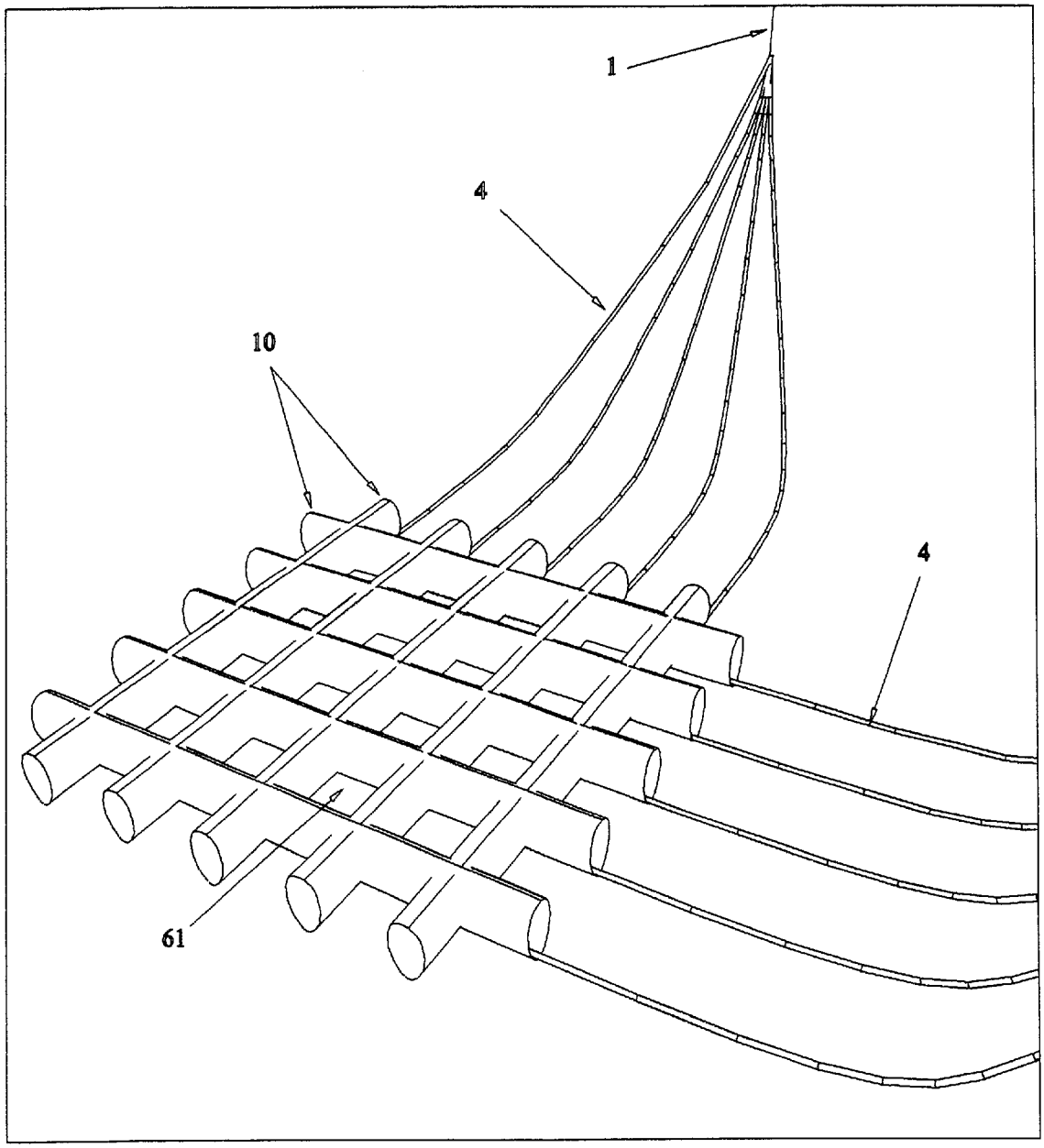

FIG. 4 illustrates cross-sectional view through the sloped borehole 4, a BHM tool 14 and a cavern 10;

FIG. 5 illustrates driving of a sinking tunnel while removing a BHM tool from a borehole;

FIG. 6 is the same as FIG. 5 with possible trajectories of a water jet 24 and slurry 27;

FIG. 7 illustrates driving of a sinking tunnel while inserting a BHM tool into a borehole;

FIG. 8 is the same as above but with a bottom head "reverse" assembly and detailed schematic of injection of the slurry from a cavern by a water jet;

FIG. 9 illustrates driving of a raising tunnel while removing a BHM tool from a borehole;

FIG. 10 is the same as above but the tool is inserted into a borehole;

FIG. 11 is a cross-sectional view of a double-stroke tunnel;

FIG. 12 is the 3D perspective view of several spoke-shape boreholes;

FIG. 13 illustrates the offshore application of the present invention;

FIG. 14 illustrates the open pit floor application of the present invention;

FIG. 15 presents different techniques applied in development of the single ore body;

FIG. 16 presents a cross-section view of FIG. 15;

FIG. 17 is the top-down application of the present invention;

FIG. 18 shows a BHM tool arrangement for usage in a strictly horizontal borehole;

FIG. 19 is the 3D perspective view of a cross-section driven through the mine drift 50 and the present invention being applied from this drift;

FIG. 20 is a "room-and-pillar" application of the present invention

Figure 21:
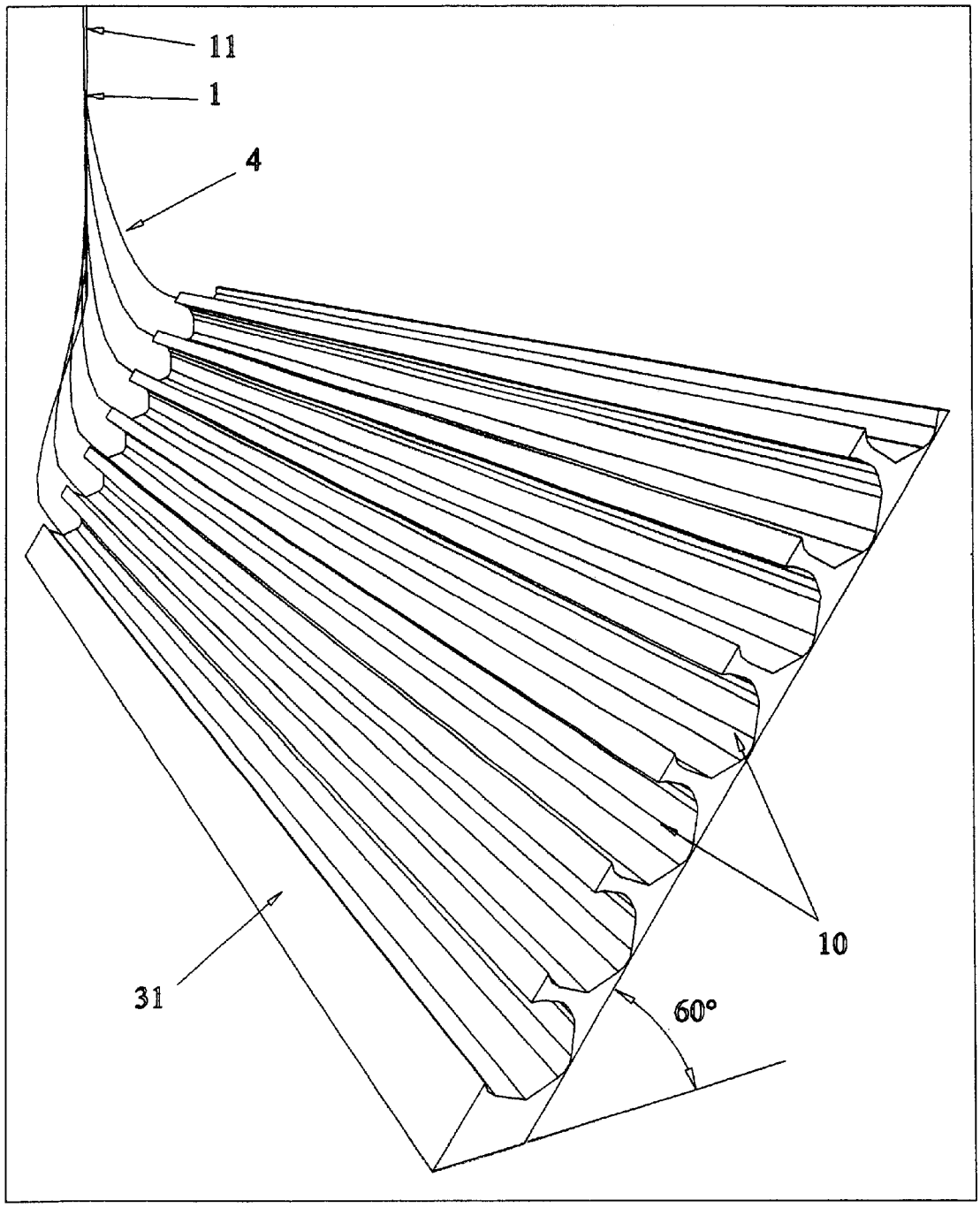
Figure 22:
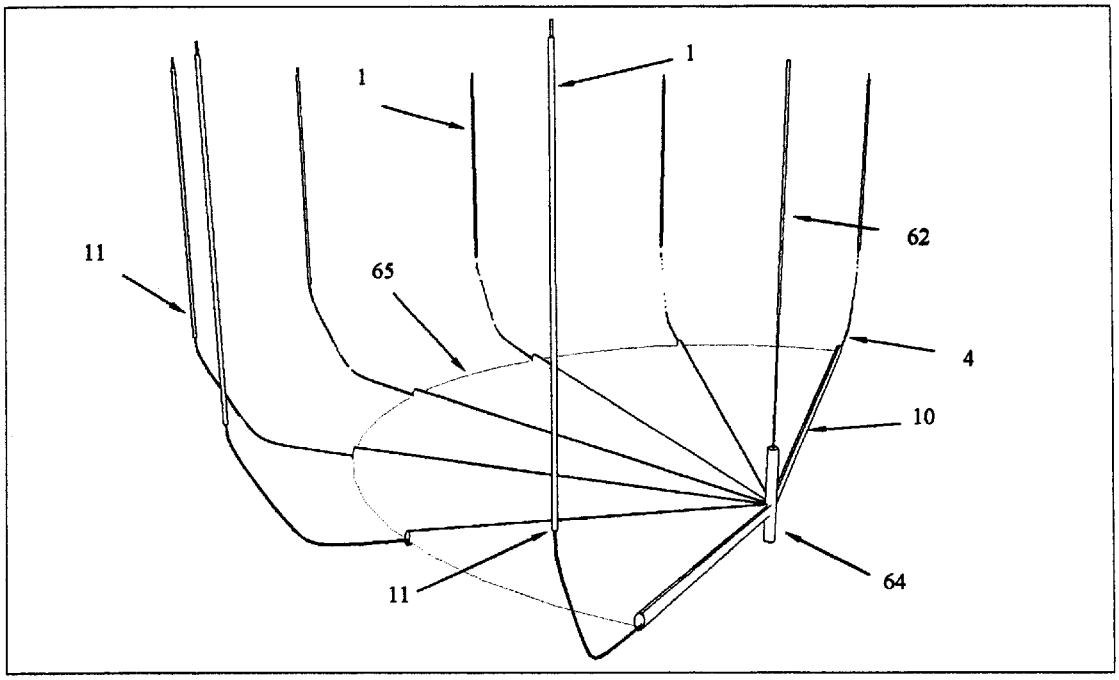

FIG. 21 illustrates a development of a 60 degrees-sloped seam through the single motherwell;

FIG. 22 illustrates a technique allowing connection of tunnels 10 driven from different boreholes.

Figure 23:
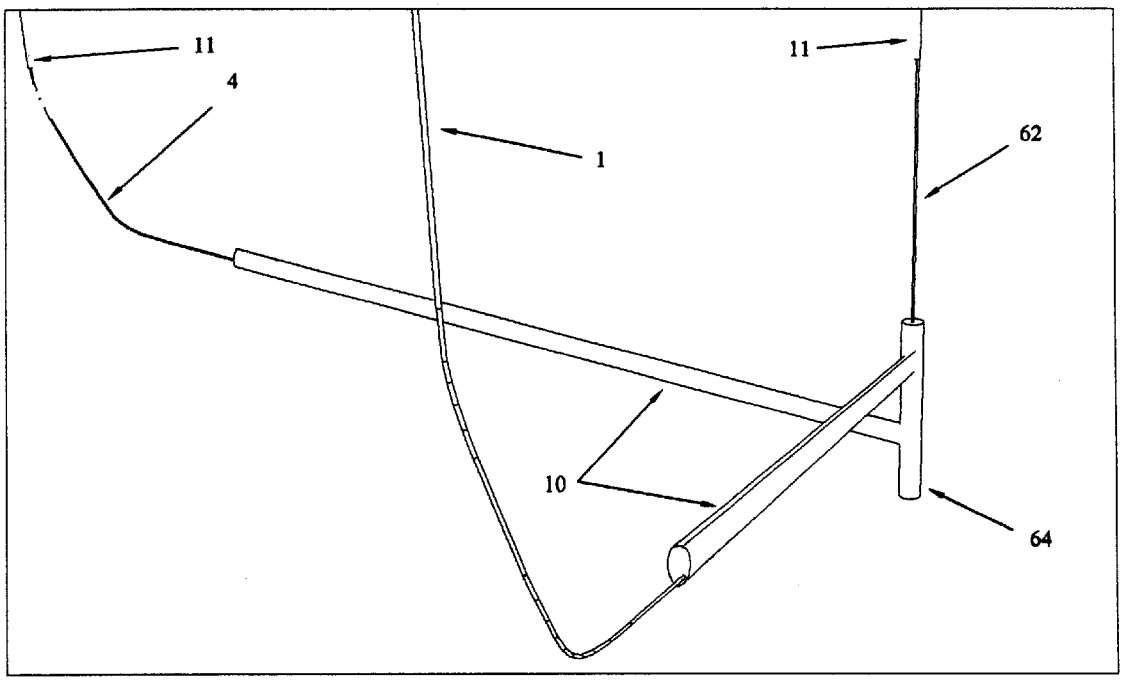

FIG. 23 illustrates technique of connecting tunnels on different elevations

THEORETICAL OPPORTUNITIES

Figure 2:
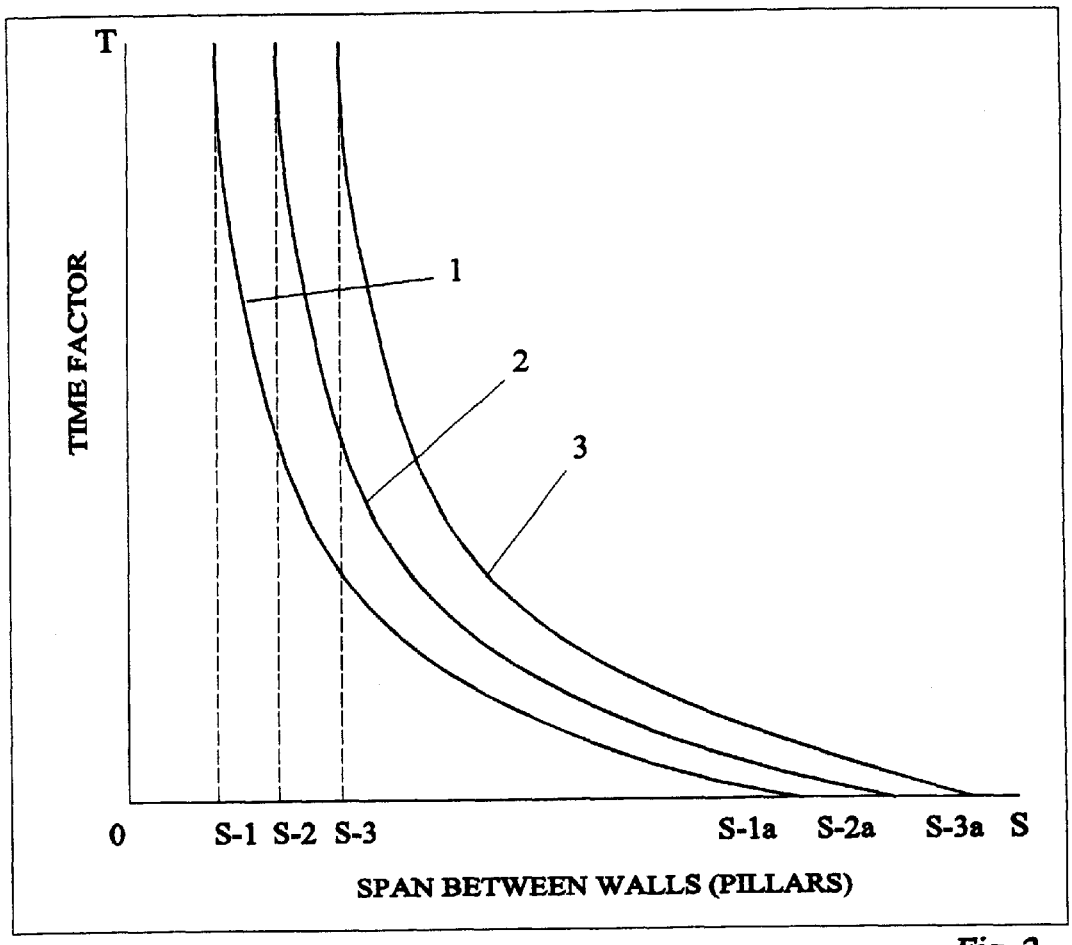
FIG. 2 is a graphical representation of relationships between caverns' span, and time to caverns' collapse.

A principal of mechanical engineering is that a beam of any material being supported on two pillars will break and collapse once the critical span is exceeded. This collapse will occur under the beam's own material weight, even without an extra "outside" force. In mining, this principal is evident when an underground void roof collapses under the cap-rock weight. In Dr. E. Hoek's text Practical Rock Engineering, 2000 Edition, Page 61 the relationship between stand-up time and pillar span for various rock materials is presented. A simple rearrangement of this graph is shown in FIG. 2, where curves 1, 2 and 3 represent different types of rock material. The upper ends of curves 1, 2, and 3 do not intersect the Time axis, which means that under the respective spans (S1, S2 or S3) these caverns will stay unsupported indefinitely. Practical illustration of this is underground tunnels and drifts staying undamaged for decades, and in some cases for hundred of years, without any timber or other support.

Conversely, points, where curves 1, 2 and 3 touch the axis S (T=0), correspond to the spans S-1*a*, S-2*a* and S-3*a* and indicate that the collapse of the respective caverns will occur instantly. All the other points on the curves 1, 2 and 3 correspond to spans which will stay open for a certain time and then collapse.

Keeping this in mind, it is easy to appreciate that a horizontal slot created by a water jet will cause a collapse of the above rock mass as soon as the depth or width of this slot reaches or exceeds the critical span for this material. In order to create such a horizontal slot, a jet has to be (1) oriented within a horizontal plane and (2) moved within that plane perpendicular to that jet. In practice, this technique is known and called "undercutting". Thus, by water jet undercutting of a rock through the extended horizontal borehole, then collapsing of the above-ore body mass and finally removing of the collapsed material, an extended cavity can be created.

This theoretical assumption is a key element of the concept of borehole mining through near-horizontal and/or inclined boreholes, as is described further herein.

DETAILED DESCRIPTION OF THE INVENTION

Following are descriptions of several preferred embodiments of this invention. These examples describe the spirit of this invention. Main procedures and their sequences may vary depending on the depth of mining, environmental and hydro-geological conditions, geo-technical tasks and several other variables. Thus, these examples are not limiting of the scope of this invention and are only used to illustrate the technology.

Figure 1:
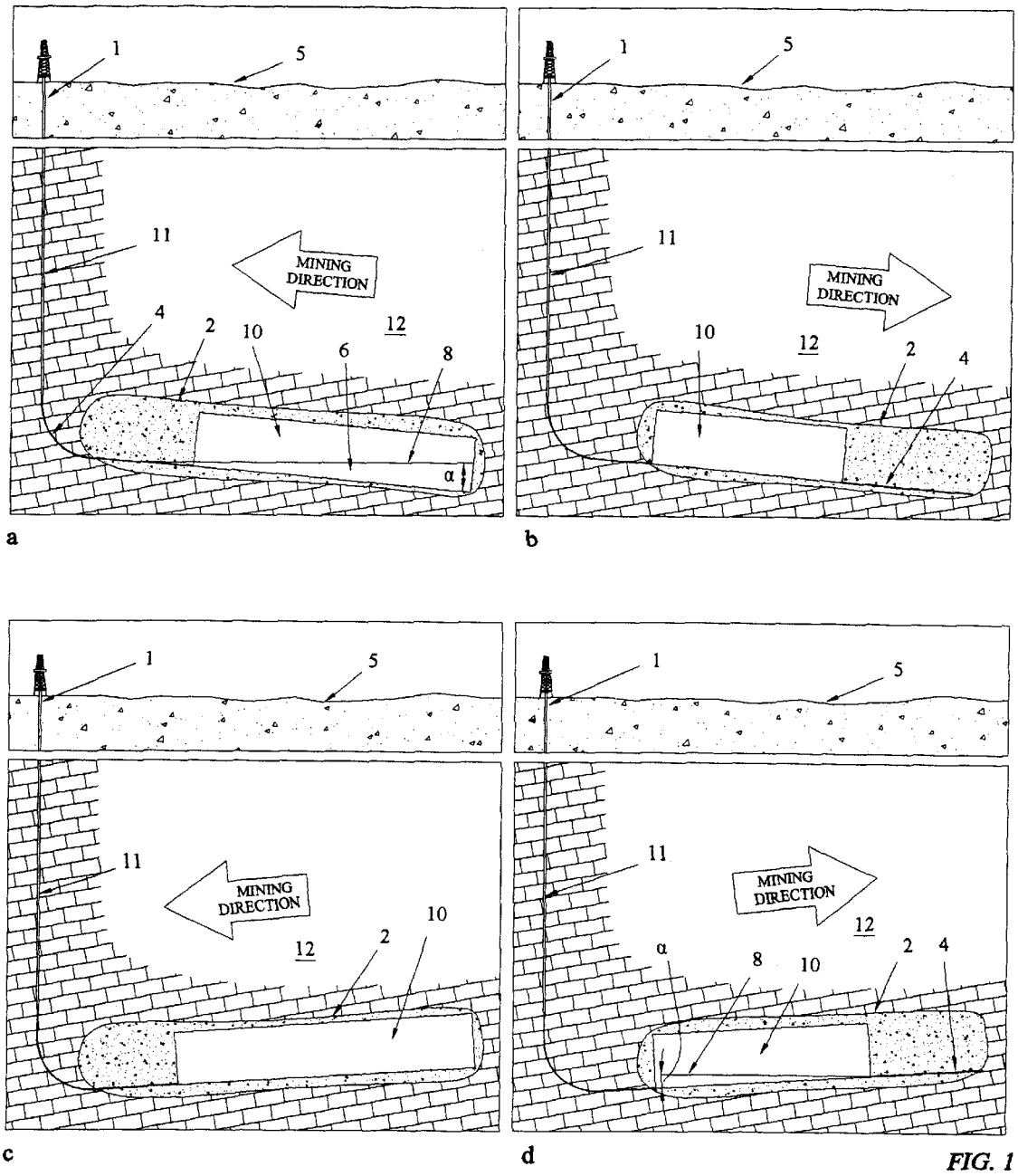
FIG. 1 is a side view of four main schematics of the preferred embodiments of the present invention.

First, a borehole 1 (FIG. 1) is drilled from a convenient location towards an ore body or working zone 2. It penetrates this zone on a shallow slope, under a low degree angle $\alpha$ to the horizontal plane. The angle $\alpha$ has a range substantially of:

$$-25^\circ<\alpha<25^\circ \quad \text{(Eqn. 1)}$$

The borehole may be sinking or raising (the angle $\alpha$ is shown between the deviated borehole 4 and the slurry level 8 in a created cavern 10. The interval of the borehole 1 outside the production zone 2 may have a casing 11 to support caprock 12 at unstable intervals.

In most cases a deviated borehole 4 is drilled through the entire working zone 2 to allow a BHM tool to travel within this interval, in the same way as conventional (vertical) BHM (see for example U.S. Pat. Nos.: 6,460,936; 5,197,783; 5,127,710; 5,031,963; 4,915,452; 4,906,048; RU2,032,074; SU1,521,874). Then, a borehole mining tool 14 is inserted into the hole 4. This tool 14 (FIGS. 7–17) comprises a bottom (working) head 16 with a hydromonitor section 18 and an eductor section 20, where "bottom" refers to the part of a tool 14 which is first inserted into a borehole 1. The tool 14 is inserted in a borehole 4 so that said bottom head 16 is located within a working zone 2. Then the actual borehole mining begins. This mining includes pumping a high-pressure water, creating a water jet 24, cutting a rock 26 (FIGS. 6 & 11), creating a slurry 6, removing this slurry from the borehole 1, creating a cavern or stope 10, and finally sliding the tool 14 in the borehole 4 to extend this cavern 10 along the pre-drilled borehole 4.

While mining and sliding the tool 14 (FIG. 4) along the borehole 1, the tool 14 is tilted in the hole 4 so that the hydromonitors' nozzle 28 is oriented under an angle $\beta$ to a horizontal plane. This positioning of the jet 24 contributes five important technological advantages.

First, an angled position of a jet allows changing and manipulating the span of a driven cavern. The projection of the vector $R_c$ on the horizontal plane is nothing but the span $S_c$ of the cavern, or:

$$S_c=R_c*\text{Cos}\ \beta, \quad \text{(Eqn. 2)}$$

where: $S_c$ is the span between the walls 7 of a driven cavern 10 and $R_c$ is the water jet 24 cutting reach-radius.

Equation 2 shows that the smaller the angle, the bigger the span $S_c$ (see FIG. 4). For instance, if the stability of the rock 3 is very low, the angle $\beta$ should be increased. It will decrease the span $S_c$, and ensure the required stability of the cavern 10. When the angle $\beta$ equals 90 degrees, the span $S_c$ is minimal (theoretically it equals zero), which in reality means the creation of a vertical slot, the most stable underground cavity.

Conversely, when the jet 24 is oriented horizontally ($\beta$=0°), it allows the creation of a cavern 10 with the widest possible span $S_c$, for that given water jet 24. If the critical span is exceeded then obstructions created by the collapse of the roof 32 may keep the maximum span $S_c$ from being achieved, by interfering with the jet 24. Thus, the BHM tool should be oriented under some certain angle $\beta$, depending on the rock/ore physical properties (hardness, stability) and a given technological task.

Second, the angle $\beta$ creates some self-transporting conditions for the pregnant slurry and rock chunks included in it. From the rock face this material is flowing downhill where the BHM tool 14 with an eductor 20 is located. Again, by changing the angle β, a required slope 34 can be formed. This is important for mining of heavy elements, such as gold, especially in placer-type deposits. The conventional (vertical BHM) technology does not allow maintaining steepness of slurry transporting slopes.

Third, creating a rock mass collapse by undercutting allows the simplification of BHM tool manipulations. BHM tool rotation is no longer required. The only tool manipulation required is sliding it in and out of a borehole.

Some technological tasks require a rotation of a BHM tool back-and-forth (for instance, to create sectoral caverns as in U.S. Pat. No. 4,536,035). This reverse-directional rotation means that 50% of operational time the tool string is under the "negative" torque which is trying to unscrew this string. In order to overcome this, a special type of thread-lock connection must be installed. This makes the tool heavier and more expensive. More importantly, these multiple extra metal units, attached at each connection, eat up the precious volume inside the borehole, increase the working water pressure loss and finally negatively affect the BHM process. Thus, elimination of tool rotation eliminates the entire set of these problems.

Fourth, as described above, the BHM tool is positioned underground under two angles: the angle α between the tool axis and the horizontal plane and the angle β between the jet and the same horizontal plane. The range of these angles, as it was discussed above, may vary ($-25°<\alpha<25°$ and $0°<\beta<90°$). Here, the angle β ensures the slurry flows down towards the tool while, the angle α ensures this slurry flows toward the tool's suction unit—an eductor. The angle α also ensures two different trajectories for the water jet and the slurry flows, so they never interfere with each other (FIG. 6). Additionally, this double-angled position of the tool is focusing the slurry flow towards the eductor during the borehole mining, for either "top-down" or "bottom-up" development schematic. This technique is impossible during the conventional "bottom-up" vertical borehole mining where the slurry flow falls down like rain avoiding the eductor suction zone.

Fifth, and most important, this invention further increases safety for operating personnel compared to vertical borehole mining. With vertical BHM, the personnel and equipment are located directly above the working zone. The collapsing zone, located just above the working zone, may reach the surface causing subsidence. This can be a dangerous situation. This invention completely solves this problem by moving the working-collapsing zones away from the operating site, whether through deviated boreholes or mining from underground mines.

These five advantages allow the BHM process to be more stable, controllable, predictable, simple and cost-effective, and by "turning" it from vertical to near horizontal, make it more efficient and safe.

Tool Operating and Fluids Circulating System

Four main deviated BHM techniques are described in FIGS. 5–10

1) Slow Sinking Boreholes

1a) The BHM tool 14 is pulled out of a borehole 1 while mining (FIGS. 5 and 6).

The borehole 1 is drilled substantially vertically from the land surface 5 and then deviated 4. Within the working interval 2 the borehole 4 is slowly sinking at angle α. Borehole mining is then begun at the lowest (farthest) point 38 of working interval 2 by moving the tool 14 upward, out of the hole 1.

For this application, the BHM tool 14 arrangement is the "standard": an eductor 20 is placed at the tools' 14 very bottom 22, and a hydromonitor section 18 is located immediately above it. Since the borehole 4 is not horizontal, but is "slow sinking", the eductor 20 is located slightly below the hydromonitor 18. If the eductor's pumping rate is equal to or greater than the hydromonitor's discharge rate, this arrangement ensures "dry" conditions for the jet 24. In other words, if the eductor 20 removes the slurry 6 from the cavern 10 faster than it comes-in (working water plus possible ground waters); the jet 24 will fly through the air. Otherwise, the jet 24 will be flooded.

Water jet 24 cuts the rock 26 that falls down 27 by the force of gravity and mixes with water creating slurry 6. Since the borehole 4 is not horizontal, the jet 24 is not vertical. This deviation of the jet 24 is toward the end 22 of the tool 14, or towards the eductor section 20. Thus, the jet 24 flies at angle α from vertical, but the slurry 6 falls down by gravity or mainly vertically, and therefore, these two flows do not intersect each other. In addition, the angle β allows the creation of slope 34 (FIG. 4) that directs the slurry 6 towards the eductor 20. The slurry 6 reaches the vacuum zone created by the eductor 20, which delivers it to the land surface 5. While mining and removing the tool 14 from the hole 4, the slurry level 8 rises with the eductor intake ports 9, and the cavern 10 is left partially filled with slurry 6.

1b) The BHM tool 14 is lowered down into a borehole 1 while mining (FIGS. 7 and 8).

The well 1 is drilled as above, but borehole mining is begun at the upper point 15 of the production interval 2 (usually, the upper point of the deviated section 4 of the borehole 1). While mining, the tool 14 is inserted deeper into the well 4. This application may require one of two possible tool 14 configurations, which are described below.

First, the "standard" configuration: eductor 20 below—the hydromonitor 18. In this arrangement (see inset on FIG. 7), the eductor's inlets 9 will constantly be inside the borehole 4. In this case, the gap 40 between the borehole 4 and the tool 14 should be wide enough for slurry 6 chunks to be able to reach the eductor inlets 9. This gap 40 may be used as a calibrator/separator for the slurry chunks. For this purpose, the gap size should not exceed the slurry intake ports 9 aperture. In this case only "calibrated" chunks will reach the eductor 20.

Second, the "reverse" configuration: the hydromonitor 18 located below the eductor 20 (FIG. 8). The hydromonitor 18 is now located at the very bottom part 22 of the tool 14 and the eductor 20 is immediately above it. In a slow sinking borehole the vertical difference between the eductor 20 inlets 9 and hydromonitor nozzle 28 will not exceed 5 cm–10 cm (2"–4"). However, in the sinking borehole, the hydromonitor nozzle 28 will be slightly flooded. This thin level of slurry covering the nozzle 28, will not significantly break the jet 24 nor negatively affect its workability, but will create an extra effect, which is simply an injecting 13 of some portions of slurry 6 from the stope 10 and throwing it back against the rock face 26, along with the main working water jet 24. Thus, some portion of working water from the stope 10 will be "recycled" and be used in the cutting process multiple times without reaching the surface 5 and going through the pumping station (not shown). This increase of the cutting water mass will improve both the cutting and the transportation of the rock to the eductor 20. While lowering the tool 14, the level 8 of the slurry 6 in the cavity 10 will also be lowered. Upon completion of borehole mining, the created stope 10 will be "dry" (if no ground waters infiltrate).

This technique may have one disadvantage. If the created stope 10 even partially collapses while mining, the tool 14 may stick. This collapse, however, will not severely damage the tool 14, since it is completely lying on the "ground".

2) Slow Raising Boreholes.

2a) The BHM tool 14 is pulled out of the borehole 1 while mining (FIG. 9).

BHM is started at the highest point 42 of the working interval 2 (or the deepest point of the borehole 4) and the tool 14 is slowly pulled out from the borehole 4. This application again may use either arrangement of the BHM tool 14: the "standard" or the "reverse". The standard configuration will work the same way as described in method 1*b*. Since the eductor inlets 9 are located slightly above the monitor nozzle 28, the water jet 24 will be partially flooded, creating the same effect explained above. The only difference from method 1*b* is that the tool 14 is being pulled out of the well 4 instead of being inserted into it. The reverse tool 14 modification (not shown) will keep the eductor inlets 9 constantly inside the borehole 4 while mining. It will secure the "dry" conditions for the water jet 24. After the borehole mining is done, the stope 10 will remain free of water, regardless of the tool 14 configuration (again, if there is no ground water infiltration).

2b) The BHM tool 14 is inserted into the borehole 1 while mining (FIG. 10).

BHM is started at the lowest edge 44 of the working interval 2, inserting the tool 14 deeper into the hole 4. The configuration of the tool 14 is "reversed." In the raising part of the borehole 4 the eductor 20 will be lower than the hydromonitor nozzle 28. The eductor 20 will keep the slurry level 8 below the nozzle 28 allowing the jet 24 to fly trough the air. Slurry 6 will arrive at the eductor section 20 directly from the cutting face 26 by the force of gravity. The "standard" arrangement of the tool 14 is not applicable for this technique because the eductor 20 will be located not only above the nozzle 28, but also inside the borehole 4. This will increase the travel path for the slurry 6 and create certain difficulties for its suction.

When mining reaches the upper edge of the production zone 2, the created stope 10 will be at least partially filled by the slurry 6. On the trip back out of the borehole 4, the tool 14 may be used again to clean the stope 10 and dry it out by pumping away this remaining slurry 6.

Similar to 1b, this technique may have a complication if the created cavern 10 collapses while mining. It may lock the tool 14 inside the cavern 10. However, rescue procedures are reasonable because the tool 14 is on the "ground", unlike in a "vertical" borehole mining, where such a collapse usually bends the tool making it irreparable and even unrecoverable.

In all four techniques, the pre-drilled borehole 4 may collapse before or while mining. In order to re-drill the collapsed intervals, the tool 14 may have a drill bit 17 powered by a hydro-turbine, any other type of agitator, or an extra nozzle(s) facing ahead to clean the borehole.

Double-stroke BHM Technique and Multi-nozzle BHM Tool

All four techniques described above as single stroke techniques could be repeated while moving the tool 14 in the opposite direction after the completion of the first stroke with at least a doubling of extracted material. This only requires a second tool stroke with the nozzle 28 pivoted substantially symmetrically (relative to vertical) to the first direction as shown in FIG. 11. After the extraction of a "second half" 41 of the material, a new collapse may occur as the span $S_c$ is doubled. The height (H), Span ($S_r$) and volume of the resulting cavern 10 may be more than doubled due to significantly exceeding of the original critical span $S_c$. With extension along the borehole axis, these types of caverns would be more appropriately called "BHM tunnels" with a width ($S_r$) easily equal to 3–5 m (10–15 ft) or more, and heights (H) of up to 10–20 m (30–60 ft) or more. After the material is removed, these tunnels could be used as storage for oil, gas, or other gaseous or liquefied products. They also may be used for drainage or other hydro-geological or environmental projects and purposes.

As mentioned above, the volume of material recovered during the second stroke will probably be 1.5–2.0 times larger then that mined during the first one. Consequently, the second stroke also may take a longer time to accomplish (to remove all the collapsed material). To control the process, the angle β of the 1st and 2nd strokes may not be equal to each other. In other words, the angle β allows controlled volumes of material to be extracted during each stroke. Obviously, more than two strokes can be applied to accomplish a technological task.

In a very friable, unconsolidated material, such as watered quartz sands, the BHM tool may have two nozzles shooting substantially symmetrically, in opposite directions. The angle between these nozzles should be changeable. They also may be spread apart along the tools' main axis. The double nozzle BHM tool will allow the elimination of the second stroke and thus simplify the technology.

Multiple Directional and Sub-level BHM Networking

Utilizing deviated borehole drilling techniques, a spoke-type set of boreholes can be created through a single mother-well 1 as shown in FIG. 12 (see for example the U.S. Pat. Nos. 6,454,000; 6,439,320 and others). Then several mother-wells could be drilled back-to-back to fill the developing horizon with the most appropriate tunneling network of the entire development 63. The arrow 25 points the direction of the development of the pattern 63 which size can easily be one square mile. The area located under the middle borehole 39 can be developed from one of two other boreholes before or after the situation presented in FIG. 12.

The pattern shown in FIG. 12 can be repeated more than once on different elevations from the same mother-wells. Additionally, these techniques are applicable from the land surface, underground mines, water surface 30 (FIG. 13), ocean platform 36 or floating vessels, where the mined material 48 can be directly loaded from below the seafloor 45 onto a barge 46 to be transported to its next destination.

If drilled from an appropriate underground working or open pit floor (FIG. 14) only the straight (sinking or raising) portion of a borehole 4 is required. This illustration shows how steadily overburden volumes grow following the dip of the ore layer 3. With the BHM tool 14 introduced as a highwall miner, the ore body 3 can be recovered without removal of overburden caprock 12. Therefore, further development of the deposit 3 can be continued beyond the surface mining economic limit. All four main techniques described above (and others devised by those in the craft), are applicable for those straight boreholes as well.

FIGS. 15 and 16 illustrate some of the different borehole mining techniques that are applicable within one ore body based on the present invention. Along with pre-cut underground workings 50, a vertical mother-well 1 is drilled (FIG. 15). This allows the development of the ore body 3 by boreholes 52 drilled straight (sinking or raising) from these workings 50 and by deviated boreholes 4 as it was described earlier. Arrows 49 show the direction of mining in the individual borehole. FIG. 16 is the cross-sectional view A—A of the ore body 3 driven as it shown in FIG. 15. The arrow 53 shows the direction of development of the entire working zone 3, which points towards the production of future caverns 55. The development of the zone 3 is started from the lowest horizons. After the material is removed, the caverns 10 are back-filled with waste or hardening material 54. This allows back-to-back cutting of caverns 10, prevention of collapse of the above laying horizons and development of the next horizon. Those caverns 10 that are adjacent to existing underground workings 50 can be developed straight from these workings. FIG. 15 also illustrates the selectivity of horizontal borehole mining techniques, allowing waste intervals 35 to remain untouched while extracting only economic zones.

By manipulating the angle β and tool 14 velocity, a cavern 10 shape can be adjusted. A reduced size of such a cavern driven at the edge of the ore body 3 to decrease the ore dilution is illustrated 56.

Without a back-fill (FIG. 17) the same body could be developed in the opposite (top-down 57) direction. In this arrangement, the caprock 12 will keep moving down, following sequentially collapsing caverns 10. FIG. 17 illustrates a smooth subsidence of caprock 12 and land surface 5. After each horizon 51 is developed, some residual ore 58 from pillars 47 between caverns and other pockets may still remain underground. However, as soon as this material is accumulated at the lowest zone 43 of the body 3, it can again be penetrated by boreholes 4 and recovered in the same manner as described above to maximize the ore 3 recovery.

Extended horizontal BHM technology is applicable in the environmental business in construction of extended collectors and underground walls or curtains. For this purpose, the hydromonitor 18 should be oriented within a vertical plane going through the borehole 4 main axis. Since the present technology may require a low-degree slope, a borehole 1 (and a tool 14), and thus the water jet 24, will be deviated from the horizontal and vertical lines, respectively. The jet 24 deviation here is again playing a positive role. Deflected water/slurry 27 will not interfere with the jet 24, as shown in FIG. 6, and thus will not break the jet and decrease its productivity. However, if the borehole is strictly horizontal, the hydromonitor 18 may be installed slightly deviated from perpendicular to the tool main axis as illustrated in FIG. 18. In this case, the tool 14 will lie horizontally, but the jet 24 will still be deviated from the vertical line and thus shoot again towards the eductor section 20. Thus, the BHM tool 14 may have an adjustable hydromonitor nozzle 28 installation allowing it to be oriented in the range of +/−10° to 15° from perpendicular to the tool axis while mining.

While moving the tool 14 in-and-out of the borehole 1, the jet 24 will cut a vertical slot 60. Then several other vertical slots could be connected to each other forming an extended collector of any length or configuration. It should be mentioned here that similar technology is also available by traditional (vertical) BHM. However, the present horizontal borehole mining technique will minimize drilling requirements dramatically.

It should also be noted that for filling of the vertical slot 60 with concrete or mud, the sinking hole (FIGS. 5–8) is most appropriate. After the completion of the slot 60, the pipe delivering a filling agent should be inserted back into-the slot. This pipe outlet should be placed near the lowest point of the slot. The injection of the agent and removing the pipe are made simultaneously. Since cement or mud is heavier than any water possibly remaining in the slot, this agent will replace the water. This replacement will proceed upward, towards the mother-well 1. This continuous back-fill will assure monolithic construction of a barrier. If drilled and filled with concrete near the surface 5, this technology can be used for construction of foundations for building, river bank reinforcement and other applications. It may have exclusive application in permafrost, swamp, other unstable zones, and similar areas including the Polar zone.

While creating the stope 10, some intervals can be left uncut, to aid in caverns stability. This will create a series of stopes along the borehole 4 as illustrated in FIG. 15. If necessary, these caverns 10 can be isolated from each other by plugging the borehole 4 between these caverns 10. This technique may be applicable in burying radioactive waste and other similar projects.

Figure 3:
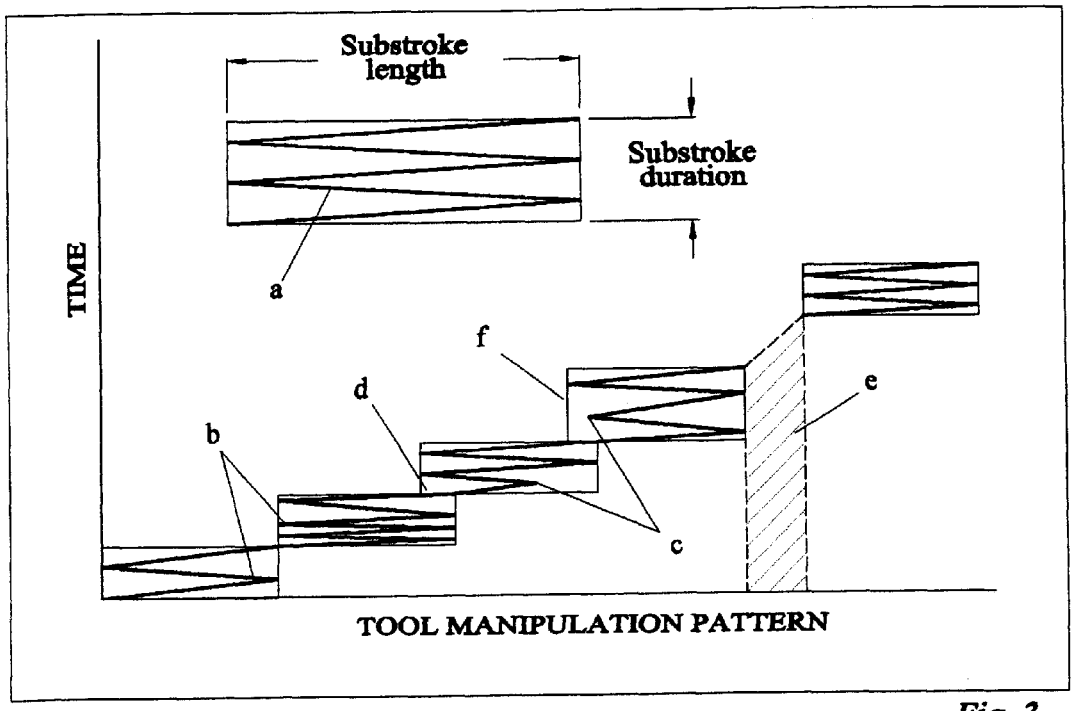
FIG. 3 is a graphical representation of the tool manipulation as a function of time.

Repetitive sliding of a BHM tool may be limited by the height of the drill rig tower. In other words, the height of the tower dictates the maximum length of the tool sub-stroke. To go deeper or shallower, the drill string should be extended or shortened, respectively. The graph in FIG. 3 shows one possible tool path a as a function of time. The graph also shows that the number of repetitions b within one sub-stroke and their length c may vary. Sub-strokes may have different duration f and overlap each other d. Finally, a time and space gap e may be introduced in between neighboring sub-strokes (see also FIG. 15).

Additional applications of the present invention discussed below provide an indication of the possibilities it provides. FIG. 19 is a 3D perspective view of straight-raising boreholes 52 and caverns 10 driven from underground drift 50 (blocks are cut and spread apart in the drawing for clarity). Here, the cutting of the cavern 10 in block 59 is shown in progress. The dashed lines 33 represent possible collapsing and subsidence zones which follow the tunnels 10. To protect the drift 50 from a possible collapse, a safety barrier 37 should be left at the end of each borehole 52. Thus, the present technology not only allows the effective extraction of rock material, but also the removal of collapsing zones away from operating sites. In comparison to the conventional borehole mining this is a significant safety improvement.

FIG. 20 illustrates the "room-and-pillar" mining system applied from two mother-wells 1. Here, tunnels 10 intersecting each other create a network with pillars 61. This is applicable when no subsidence is desired but back-fill is not permitted.

FIG. 21 illustrates a development of a steep (60° or greater) vein 31 through a single mother-well 1. Its bottom part has multiple deviated boreholes 4 penetrating the vein 31 at different depths parallel to each other. Finally, the vein 31 is extracted by caverns 10 driven along those deviated boreholes 4.

FIG. 22 shows a fan-shaped set of sinking boreholes 4 connected to the central pump-out borehole 62. The bottom part of the borehole 62 is under-reamed 64 by a conventional vertical BHM technique. This under-reamed section 64 may have a diameter similar to the span of tunnel 10 which simplifies connection of these features. This technique can be used in drainage, collection of a polluted aquifer and similar projects. An imaginary funnel 65 through the deviated boreholes 4 illustrates filtrating-collecting passage of ground waters.

FIG. 23 shows one possible way of connecting two extended tunnels 10 driven at different depths.

Tool Tilting (Nozzle Orientation) Control

As indicated in the discussions above, a precise orientation of the hydromonitor nozzle 28 while borehole mining is a very critical procedure. This tool orientation can be easily controlled by any type of angle inclinometer. Standard inclinometers are available from industrial suppliers (i.e. www.usdigital.com). Single and dual axis inclinometers are available as well as an Electronic Protractor display. They may be installed in a specially waterproofed box at the tool's very bottom 22 and should include power supply source (rechargeable batteries), inclinometer, signal digitizer and radio transmitting system, similar to that described in the U.S. Pat. No. 6,460,936. The tool's string should be used as the radio antenna.

The other available inclinometer suppliers include: Schaevitz Sensor Solutions (303-773-3383), Jewel Instruments (800-227-5955) and Acustar Electronic Clinometer.

Bottom Head

The hydromonitor 18 and hydroelevator (eductor) 20 sections should have similar-types of connecting interfaces at their input and output ends, as is described in the U.S. Pat. No. 6,460,936. It allows the manipulation of the bottom head 16 arrangement, depending on the chosen BHM working schematic, as described above.

It should be mentioned that with this technology the steepness of a borehole can exceed +/−25°. However as the steepness of the deviated borehole exceeds +/−45° this technology will perform more like declined vertical BHM. It should also be noted that very steep ore layers and veins can be developed by using this technology in low-degree tunnels, as shown in FIG. 21 and explained herein.

All methods described above will work the same for straight boreholes drilled from an underground mine, open pit floor or valley and for boreholes drilled from the land or water surface first vertically and then deviated at the required angle in the required direction(s).

Deviated Boreholes

Drilling of deviated boreholes is well known, widely patented (see for instance the U.S. Pat. Nos.: 6,454,000; 5,868,210; 5,785,133; 5,690,390; 5,460,223; 5,431,482) and has a world wide practical application, especially in oil and gas industry. The practice has several decades of application in the field and well-developed standard "off-the-shelf" equipment is available. This technology is applicable not only on a continents' soil, but also in offshore areas, polar zones, seafloor and continental exploration, construction and development. Additionally, modern drilling technologies allow not only borehole deviation in the required depth, direction and under the required angle, but also three dimensional control and imaging of the location of a drill bit at each moment. It also allows extending a deviated borehole in excess of eight km (five miles) away from the mother-well (see for example: "Drilling and Excavation Technologies for the Future" National Academy Press. Washington, D.C. 1994).

Deviated boreholes are initially drilled vertically from an appropriate location. The boreholes are then deviated in required directions such that the deviated part of the borehole meets the ore body at any required angle. Also, many deviated boreholes can be drilled from the same mother-well, decreasing over-all drilling expenses. As discussed in the examples above, the borehole mining tool can be attached to the deviated string and applied in numerous directions through the same mother-well.

Since BHM equipment is a set of standard units: pumps, compressors, drill pipes, casings, fittings, drill rigs and ocean platforms—which can be found, rented or purchased in oil and gas drill supply stores. The only unique part is the very bottom portion of the drill string, the actual bottom head or BHM tool. Its diameter and construction may slightly vary, but the tool's connecting threads have the standard oil and gas industry interface, covered for example by the U.S. Pat. No. 6,460,936. It allows for the tool to be attached to the existing well-drilling equipment and thus widens this tools' application, while staying under all general standards, safety regulations, and environmental requirements. It also lowers the overall BHM operating cost.

In comparison to the conventional vertical application, the horizontal BHM has a significantly wider set of applicable techniques. As seen from previous explanations and illustrations the beauty of the present BHM technology is the wide room for technological maneuvers. It secures more complete recovery of ore while decreasing overall operational cost, simplifying technology and reducing failure or accident risk.

Wall Support

For storage of liquefied products, injecting a hardening material, such as concrete or a plastic polymer, can reinforce the created tunnels' walls. This technology is well known in underground business and is called "shotcrete" (see U.S. Pat. Nos. 6,458,423; 5,271,974 and others). For this purpose, immediately after the completion of the tunnel, a single-wall pipe string is inserted back to the tunnel's furthest end. This string should have a set of nozzles at its end. These nozzles should deliver a concrete covering the entire perimeter of the tunnel (instead of numerous nozzles it may be one 360 Deg. nozzle). When concrete injection has started, the slow removal of the string from the tunnel is also begun. After completion, the tunnel remains coated with a casing of concrete that prevents its walls and roof from collapsing and/or in the case of a storage cavern the liquid or gas from leaking.

Conclusion

Although the concept of BHM is about a hundred years old, it nearly always was considered as a vertical technique. There were several attempts to "turn" BHM 90 degrees, but no success was reported. Meanwhile, the solution is simple: the proper nozzle orientation completely eliminates the tool rotation necessity. All that still remains from the conventional BHM activity is the sliding of a tool along a wellbore.

In comparison to the state-of-the-art technology, this invention is characterized by:

- more controllable operation nature and more predictable results;
- increased safety;
- decreased operational cost;
- widened application area;
- increased size (span) of created stope/tunnels;
- increased reliability;
- improved water jet cutting characteristics;
- simplified tool construction.

Brief analysis of the horizontal borehole mining technology easily recalls several similarities to the conventional "Highwall" and "Longwall" mining techniques, one of which is "continuous"mining. In comparison to the vertical BHM, horizontal BHM is characterized by smoother production and easier operation. It also has a significantly higher volume of extracted material per unit of borehole length.

This invention is a simple solution for state-of-the-art industry problems. Different hydro-geological conditions and rock mass physical properties may require the angle $\beta$ to be changed. It also may slightly affect the other techniques, such as tool moving speed, its diameter, necessity to work-out a horizon repeatedly (slide the tool back and forth). But the main idea remains the same: to slide the tool in a near-horizontal or low-degree extended borehole with the nozzle oriented under the angle $\beta$.

This technology expands the existing BHM technological arsenal and widens its application areas. It is applicable in development of deep, wide but thin ore layers and irregularly-shaped ore bodies which are otherwise uneconomical to develop. It is a "ready-to-go" addition to the existing underground mining techniques. It is also applicable in offshore and polar zones, for stimulation of oil, gas and water production, and for in-situ leaching. Additionally, it is applicable in the construction of multilevel networks, extended underground storage, collectors, walls, barriers and to otherwise solve various environmental problems.

What is claimed is:

1. A borehole mining method comprising:

a) driving at least one borehole, having walls, through a production interval so that within said interval said borehole is driven under a low-degree angle $\alpha$ to the horizontal plane, so that $\alpha>0$, b) insertion of a mining device within said production interval with at least one water jet nozzle, located substantially at the bottom of said mining device, whereby said nozzle creates a water jet, being able to cut rock material over a distance $R_c$ from said borehole, where $R_c$ is a jet cutting reach-radius, c) circulation of a working agent through said mining device and said borehole by its pumping at a controlled flow rate, d) sliding said device along said borehole, e) extraction of rock material by:

1) water jet cutting of said rock material, 2) creating a pregnant slurry, and 3) removing said slurry from said borehole, f) creation of at least one cavern by said extraction and said sliding, by increasing the span between said borehole walls, such that said cavern also has its walls and roof, g) causing a partial or complete collapse of said cavern walls and roof, and h) extension of said cavern by said sliding of said device along said borehole, such that said device travels substantially within said working interval, whereby, while mining, said device is positioned in said borehole such that said nozzle is oriented at an angle $\beta$ to a horizontal plane, so that $\beta>0$, where $R_c*\text{Cos}\,\beta$ substantially equals to the desired span between said cavity walls, whereby, said slurry is removed from said cavity by a pump, whose intake is installed near the bottom of said mining device, having at least one slurry intake port, located near said water jet nozzle, whereby, said slurry is removed at a rate substantially equal to or exceeding the flow rate of said working agent, whereby, while mining, said slurry level in said cavity is kept near said pump intake port, whereby, said water jet is directed at least partially above said slurry level.

2. A borehole mining method as claimed in claim 1, wherein said borehole is driven sloping down, whereby said angle $\alpha$ resides in the range $0°<\alpha<25°$.

3. A borehole mining method as claimed in claim 2, wherein mining of rock material is started at the top of said production interval followed by sliding said device down into said borehole.

4. A borehole mining method as claimed in claim 1, wherein said borehole is driven sloping up, whereby said angle $\alpha$ resides in the range $0°<\alpha<25°$.

5. A borehole mining method as claimed in claim 4, wherein mining is started at the top of said production interval followed by sliding said device up and out of said borehole.

6. A borehole mining method as claimed in claim 4, wherein mining is started at the bottom of said production interval followed by sliding said device into said borehole.

7. A borehole mining method as claimed claim 2, wherein mining of rock material is started at the bottom of said production interval followed by sliding said device up and out of said borehole.

8. A Borehole Mining method as claimed in claim 1 wherein, while mining, said device is positioned in said borehole such that said nozzle is oriented at a working angle $\beta_w$ to the horizontal plane, whereby $R_c*\text{Cos}\,\beta_w$ is substantially equal to, or less than, a span whose dimension causes said cavern walls and roof collapse after a predetermined time and thus secures said walls and roof stability substantially for the duration of said mining.

9. A borehole mining method as claimed in claim 1 wherein, while mining, said device is positioned in said borehole such that said nozzle is oriented at a critical angle $\beta_c$ to said horizontal plane, whereby $R_c*\text{Cos}\,\beta_c$ substantially equals or exceeds a critical span whose dimension causes said walls and roof to substantially collapse immediately.

10. A borehole mining method as claimed in claim 9, wherein said mining is continued during and after said collapse by further loosening the collapsed material and removing it from said cavern.

11. A borehole mining method as claimed in claim 10, wherein after said removing of said collapsed material, said span between said walls is further expanded by continuing of said water jet cutting.

12. A borehole mining method as claimed in claim 11, wherein said collapsing material is removed until said collapsing has stopped, whereby a stable cavity is formed.

13. A borehole mining method as claimed in claim 9, wherein by said collapse a fissure zone is formed.

14. A borehole mining method as claimed in claim 13, wherein, by said continuing removal of collapsed material, further expansion of said fissure zone is caused.

15. A borehole mining method as claimed in claim 1, wherein said borehole is driven from a land or water surface partially substantially vertically towards said production interval and then is deviated within said production interval.

16. A borehole mining method as claimed in claim 15, wherein said deviated portion of said borehole is driven through said vertical part more than once and in more than one direction creating a spoke-shape pattern.

17. A borehole mining method as claimed in claim 16, wherein said spoke-shape pattern is driven through said vertical part at more than one depth.

18. A borehole mining method as claimed in claim 17, wherein said vertical part is driven more than once in such a pattern that said deviated boreholes compose a substantially equally spaced tunnel-network, penetrating said working interval at predetermined depths and patterns.

19. A borehole mining method as claimed in claim 1, wherein after finishing of said sliding of said device, said device is pivoted until said nozzle is oriented again under said angle β to the horizon but substantially symmetrically relatively to the previous position, and said sliding is repeated in the opposite direction defining a double stroke motion of said tool.

20. A borehole mining method as claimed in claim 18, wherein said deviated boreholes substantially lay in the same plane and the distance between them substantially equals or exceeds $R_c$*Cos β for the single stroke and 2*$R_c$*Cos β for said double stroke.

21. A borehole mining method as claimed in claim 1, wherein, after a creation of said extended cavern, it is back-filled with a waste or hardening material.

22. A borehole mining method as claimed in claim 1, wherein a borehole mining tool is used as said mining device and includes a bottom head, comprised of at least one hydromonitor section with at least one water jet nozzle, and at least one eductor section, having at least one slurry intake port.

* * * * *